US007488085B2

(12) United States Patent
Pfund

(10) Patent No.: US 7,488,085 B2
(45) Date of Patent: Feb. 10, 2009

(54) COMPACT TASK AMBIENT LUMINAIRE WITH TWIN TUBE LAMP

(75) Inventor: David Pfund, Woodbridge, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 0 days.

(21) Appl. No.: 11/405,877

(22) Filed: Apr. 17, 2006

(65) Prior Publication Data

US 2006/0232961 A1 Oct. 19, 2006

Related U.S. Application Data

(60) Provisional application No. 60/671,980, filed on Apr. 15, 2005.

(51) Int. Cl.
*F21S 8/00* (2006.01)

(52) U.S. Cl. ..... 362/225; 362/147; 362/360

(58) Field of Classification Search ..... 362/225, 362/147, 33, 351, 355, 360, 361
See application file for complete search history.

(56) References Cited

U.S. PATENT DOCUMENTS 4,414,609 A * 11/1983 Shemitz ..... 362/33
5,160,193 A * 11/1992 Fabbri et al. ..... 362/33
6,139,169 A * 10/2000 Caferro ..... 362/291
7,029,143 B2 * 4/2006 Kiechle et al. ..... 362/147
2006/0109652 A1 * 5/2006 Pfund ..... 362/291

OTHER PUBLICATIONS

International Search Report; PCT/US06/14478; Feb. 16, 2007.

* cited by examiner

*Primary Examiner*—Thomas M Sember
(74) *Attorney, Agent, or Firm*—Cantor Colburn LLP

(57) ABSTRACT

A compact fluorescent luminaire mountable on a vertical surface is provided, the luminaire including a housing, an aperture formed at an underside of the housing, a lamp disposed within the aperture and oriented to emit light through the aperture to the vertical surface, wherein the lamp comprises first and second tube elements arranged adjacent to one another, the first tube element being proximate to the vertical surface, the second tube element being distal from the vertical surface, a shield element disposed within the aperture adjacent to the lamp and extending longitudinally therewith, where the shield element is configured to intercept first light rays emitted by the first tube element, intercept second light rays emitted by the second tube element, and allow passage of third light rays emitted from the first and second tube elements incident on the vertical surface.

20 Claims, 28 Drawing Sheets

COMPACT TASK AMBIENT LUMINAIRE WITH TWIN TUBE LAMP

CROSS-REFERENCE TO RELATED APPLICATION

This application is related to and claims the benefit of U.S. Provisional Patent Application Ser. No. 60/671,980 filed on Apr. 15, 2005, the entire contents of which are herein incorporated by reference.

BACKGROUND OF INVENTION (a) Field of Invention

The present invention relates generally to luminaires which provide ambient uplighting and task-oriented downlighting. More specifically the invention relates to a luminaire mounted on a vertical surface, such as that used with partition panels or stanchions in modular office furniture systems, where the luminaire is a task/ambient luminaire having a compact profile and utilizing a twin tube lamp.

(b) Description of Related Art

Task-ambient luminaires are well known in the industry and are especially effective at achieving high quality illumination in open office environments. Generally, they are fashioned to mount to vertical surfaces such as open office workstation partitions, walls, stanchions, etc., and are designed to direct a portion of their output in a downward direction to illuminate work surfaces and to direct a portion of their output in an upward direction to illuminate ceilings and to give general diffuse lighting to the space. Downlight distributions that broadly illuminate a vertical privacy panel directly in front of the task area are also desirable where such panels occur. Commonly, such panels are 48" to 60" tall and incorporate a luminaire positioned along a top edge of the panel.

Linear type fluorescent lamps of nominal 1" diameter (T8 lamps) or ⅝" diameter (T5 lamps) are the most popular lamps for these type of task/ambient workstation applications. Consequently, installations typically consist of luminaires of about 6, 7, or 8 feet in length, each incorporating 3', 4', or 5' long fluorescent lamps, singularly or in tandem, as dictated by the length of the unit. Generally, each workstation is provided with one such unit mounted along the top edge of the privacy panel that coincides with the primary task area of the workstation. (See, e.g., FIG. 1.) Especially large workstations and those with more than one primary task location may incorporate an additional unit. Although ambient lighting levels and unit power densities will vary somewhat based on workstation densities, each workstation receives relatively consistent task illuminance without the need for conventional supplementary task lights that otherwise do not contribute general ambient lighting to the office.

Recognizing that some open office configurations cannot accommodate relatively long, linear task/ambient luminaires, and recognizing that such luminaires may present barriers to worker interaction in open office environments where privacy partitions are intentionally very low or non-existent, it is advantageous to offer a compact task/ambient luminaire that has similar output. In as much as the cost of such a compact unit would be less than that of its traditional elongated version, such compact luminaires would be advantageously more affordable as well.

Compact long twin tube fluorescent lamps offering output nearly equal to that of comparable wattage linear lamps of twice their length are widely known and available. For example, a 22.5" long 80-watt long twin tube compact fluorescent lamp that produces 6000 lumens is available in comparison to a 58.4" long 80-watt high output T5 lamp that generates 7000 lumens. Similarly, a 21.1" long 55-watt long twin tube compact fluorescent lamp that produces 4800 lumens is available in comparison to a 46.6" long 54-watt high output T5 lamp that produces 5000 lumens. Although lamps with these relatively large wattages and outputs are not commonly employed in task and task/ambient luminaires, it is not uncommon for a typical workstation to employ 7 or 8 foot long luminaires employing two tandem mounted T8 or standard (lower) output T5 lamps totaling 50-65 watts and producing 5000-6000 lumens.

Compact fluorescent lamps may present the opportunity to offer comparable luminaires of reduced length, however their relatively larger cross-section and the relatively high luminous intensities associated with generating comparable output from a smaller source present unique challenges to the design of task/ambient workstation luminaires. For example, while a larger lamp cross-section suggests a larger luminaire profile to maintain efficiency and control, it is ultimately desirable to offer a luminaire that takes best advantage of the compact length and high luminous output of these lamps without compromising (increasing) luminaire profile. Similarly, it is desirable that the increased luminous intensity of these lamps not result in excessive workstation brightness and that an advantageous luminous balance be maintained in the workstation. Accommodation of the aforementioned single-ended compact lamps further requires that a lamp aligner/support be included in the luminaire design to support the lamp at a point distant from the lampholder/lamp base and maintain its alignment relative to the luminaire reflector and shielding components.

Particularly, a luminaire is desired which is compact in length and in profile but which provides a desirable luminous intensity and an even and balanced distribution thereof over a task area, for example, in a modular office workstation, and which provides a discrete lamp aligner/support for supporting the lamp and maintaining the lamp in a desired alignment relative reflecting and shielding components of the luminaire, and which is economical to manufacture, easy to assemble, and simple to install.

BRIEF SUMMARY OF INVENTION

A compact fluorescent luminaire mountable on a vertical surface is provided, the luminaire including a housing, an aperture formed at an underside of the housing, a lamp disposed within the aperture and oriented to emit light through the aperture to the vertical surface, wherein the lamp comprises first and second tube elements arranged adjacent to one another, the first tube element being proximate to the vertical surface, the second tube element being distal. from the vertical surface, a shield element disposed within the aperture adjacent to the lamp and extending longitudinally therewith, where the shield element is configured to intercept first light rays emitted by the first tube element, intercept second light rays emitted by the second tube element, and allow passage of third light rays emitted from the first and second tube elements incident on the vertical surface.

A shield element for use in a luminaire mounted on a vertical surface and having a lamp with parallel lamp tube portions is also provided herein. The shield element includes an elongated opaque body member configured to be disposed adjacent to and proximate to the lamp and further configured to extend substantially along a length of the lamp and an intercepting surface disposed on the body member and oriented to intercept first light rays emitted by the parallel lamp tube portions in a direction toward an upper portion of the vertical surface. The body member includes a narrow profile to allow second light rays emitted by the parallel lamp portions in a direction toward a lower portion of the vertical surface to pass around the shield element between the shield element and the housing.

Also provided is a method of illuminating a workstation with a luminaire mounted to a vertical surface of the workstation where the luminaire includes a lamp having first tube element disposed in the luminaire adjacent and parallel to a second tube element. The method includes disposing a shield element at an interior of the luminaire proximate to the parallel lamp tube portions so as not to be directly viewable by a viewer of the luminaire, intercepting first light rays at the shield element emitted by the first tube element in a direction toward an upper portion of the vertical surface, intercepting second light rays emitted by the second tube element in a direction toward the upper portion of the vertical surface, and allowing passage of third light rays emitted from at least one of the first and second tube elements where the third light rays illuminate at least a part of the vertical surface.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
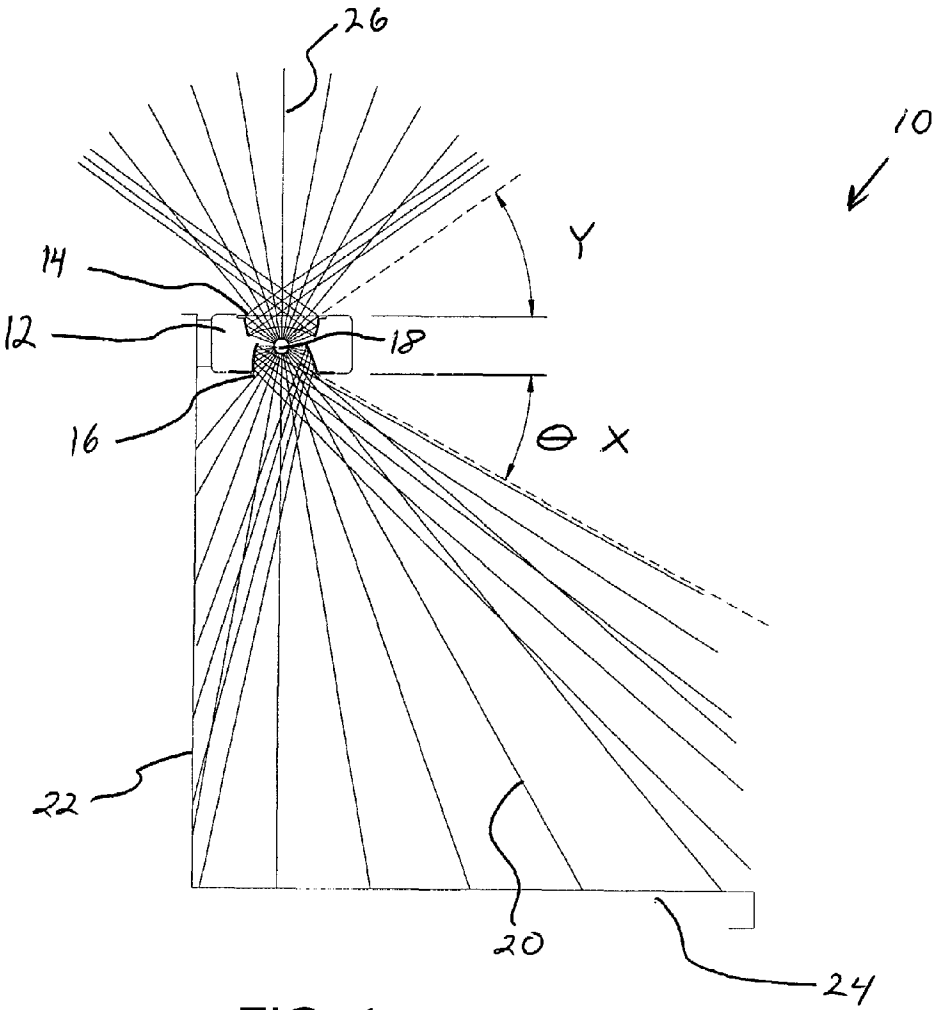
FIG. 1 (Prior Art)
FIG. 1 is a cross-sectional view of a conventional task/ambient workstation.
Figure 2:
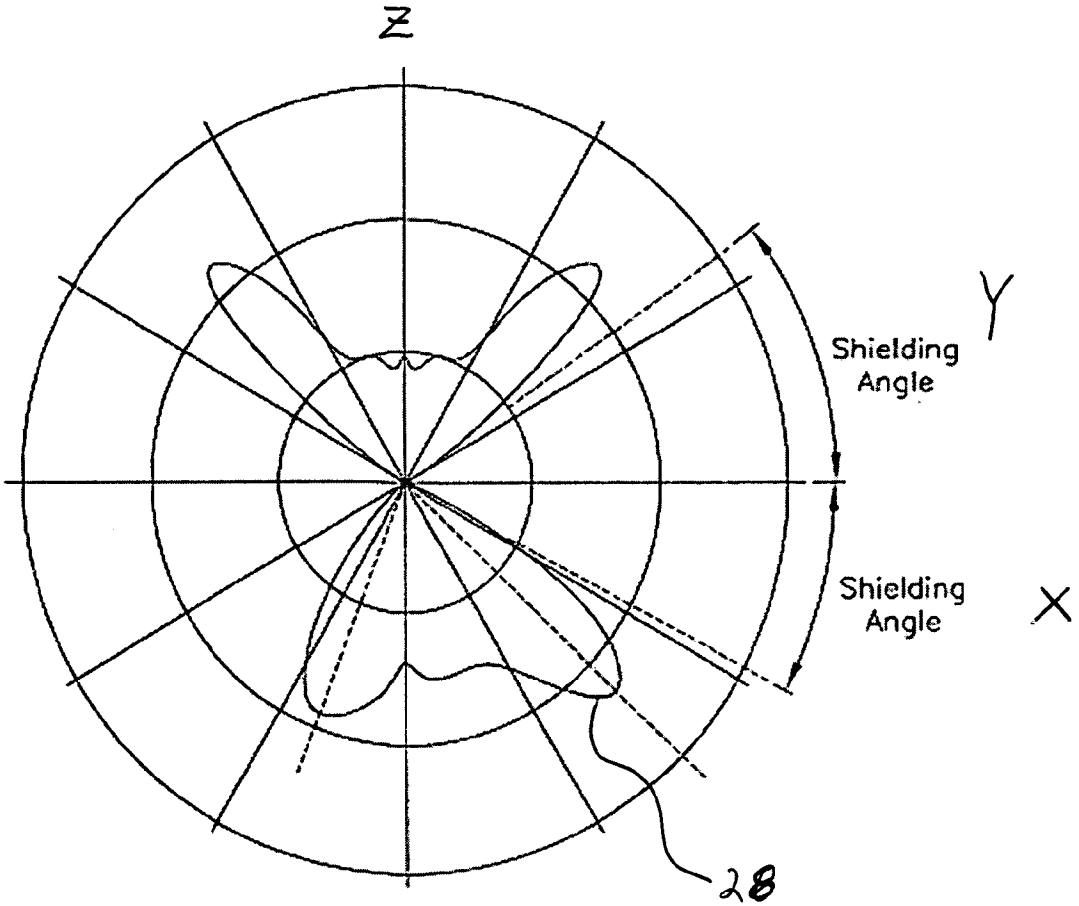
FIG. 2 (Prior Art)
FIG. 2 is a candlepower distribution curve representing luminous output in a transverse plane of the luminaire of FIG. 1.

FIG. 1 illustrates a conventional workstation 10 with a task/ambient luminaire 12 having a top aperture 14 and a bottom aperture 16 and including a typical single elongated fluorescent lamp 18 (or multiple lamps in tandem). The lamp 18 is configured and positioned within the luminaire to provide downlighting 20 for illuminating a vertical surface 22 and a horizontal surface 24 of the workstation 10. As shown, the lamp 18 also provides general ambient uplighting 26. Typically, such a luminaire 12 incorporates features to control glare by establishing a downlight or tasklight shielding angle X to shield a worker (not shown) seated at the workstation 10 from brightness and an uplight shielding angle Y to shield a worker standing nearby from uplight brightness. Such a task/ambient luminaire 12 commonly provides a symmetrical uplight distribution. The corresponding downlight distributions, on the other hand, is typically asymmetric so as to maximize a uniformity of lighting on the immediately adjacent vertical surface 22 and the horizontal surface 24 located below the luminaire 12. This distribution is illustrated in FIG. 2 where a downlight luminous output 28 of the luminaire 12 is asymmetric relative to a vertical axis Z.

It is noted that that like elements and features of the drawings are indicated herein and throughout the various Figures with consistent reference numerals and are not re-introduced nor re-described in detail for sake of brevity.

Figure 3:
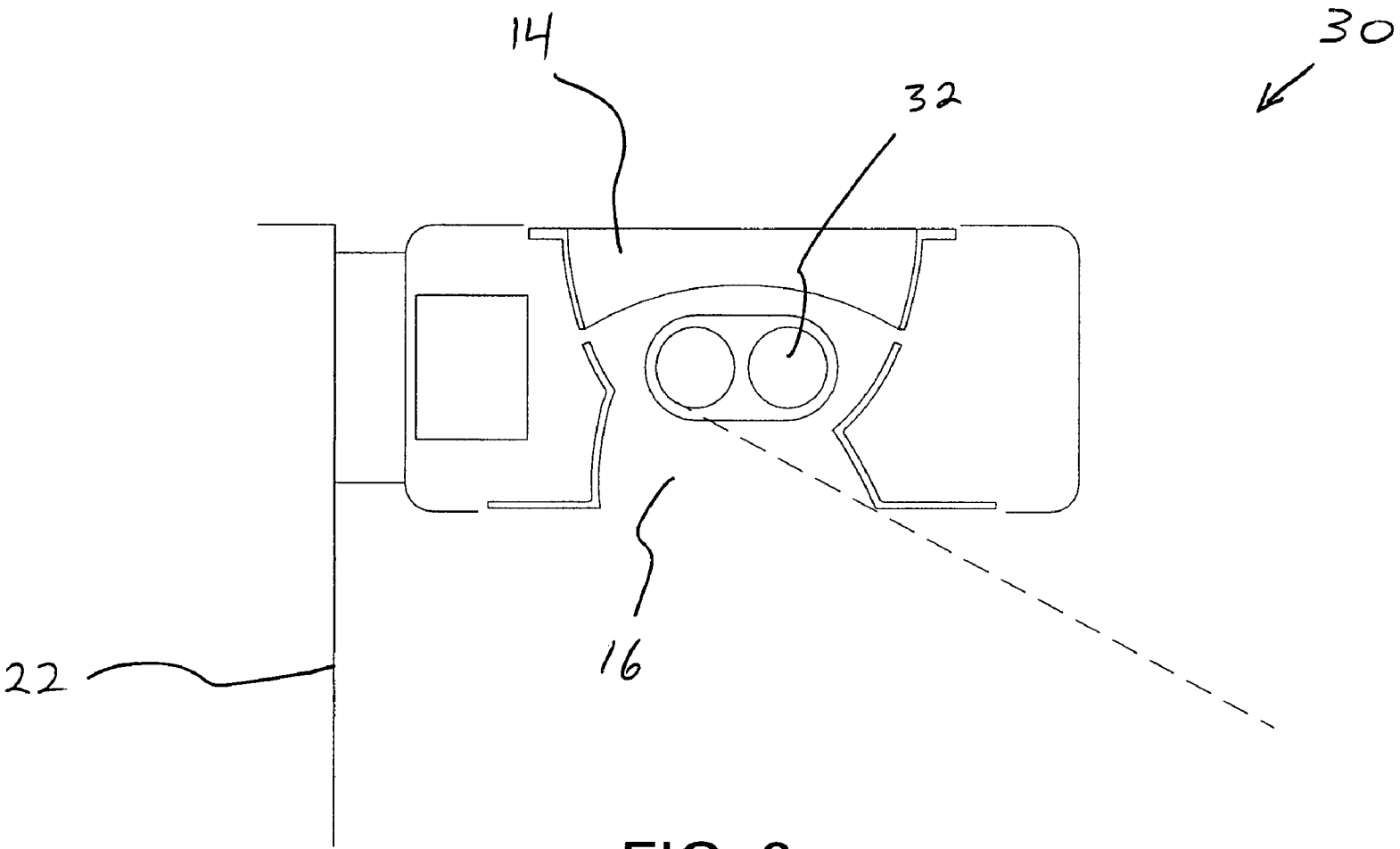
FIG. 3 (Prior Art)
FIG. 3 is a cross-sectional view of a conventional low-profile task/ambient luminaire fitted with a compact, long twin tube fluorescent lamp.

FIG. 3 shows a similar profile luminaire 30 incorporating one (or more) compact twin tube fluorescent lamps 32. The luminaire 30 may be half a length of the previously considered luminaire 12 while still capable of producing an equivalent or greater luminous output due to the use of the compact twin tube lamp 32. while the inventor has separately detailed advantageously controlling and distributing uplighting from such a luminaire (see, U.S. patent application Ser. No. 10/995,928, filed on Nov. 22, 2004, entitled "Louver for Low-Profile Luminaires", now U.S. Pat. No. 7,246,924, the entire contents of which are herein incorporated by reference) there is a need to alleviate a resulting concentration of direct/downlight in a workstation employing the twin tube luminaire 32, especially on vertical surfaces disposed adjacent to the twin tube luminaire 32. vertical surface illuminance in the vicinity of such twin tube task and/or task/ambient luminaire 30 is potentially twice that encountered in the case of the single-tube luminaire 12 (see, e.g., FIG. 6) and is a source of excessive luminance ratios in the workstation 10.

Figure 4:
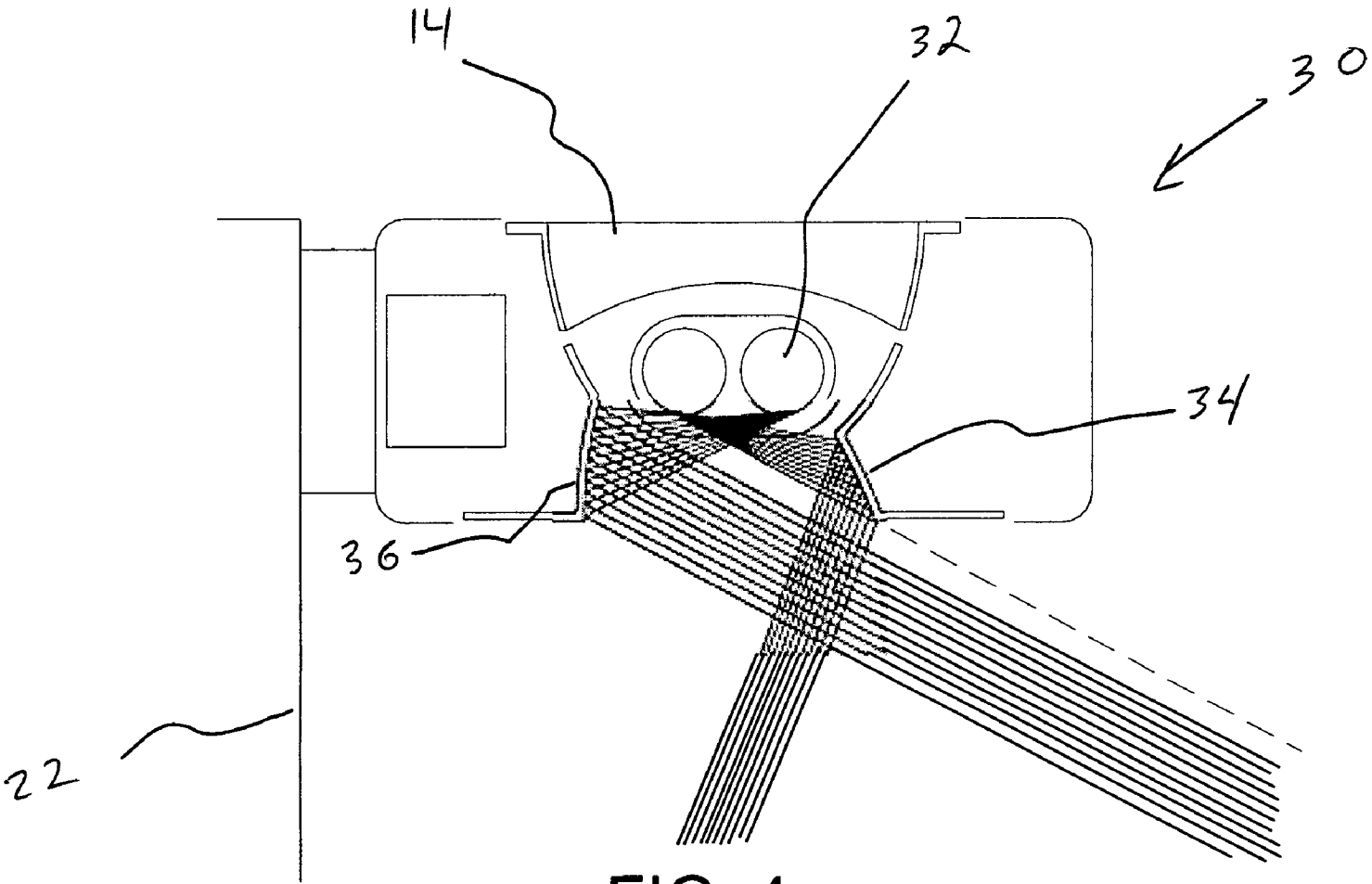
FIG. 4 (Prior Art)
FIG. 4 is a cross-sectional view of the luminaire of FIG. 3, illustrating an effect of conventional downlight reflectors.

FIG. 4 shows the luminaire 30 including a first reflector 34 and a second reflector 36 which are configured to redirect the lamp output into desirable zones within the workstation 10. As shown, the first reflector 34 redirects light from the twin tube lamp 32 in a direction toward the vertical surface 22. The second reflector 36 redirects light from the lamp 32 in a direction toward the horizontal work surface 24 (not shown).

Figure 5:
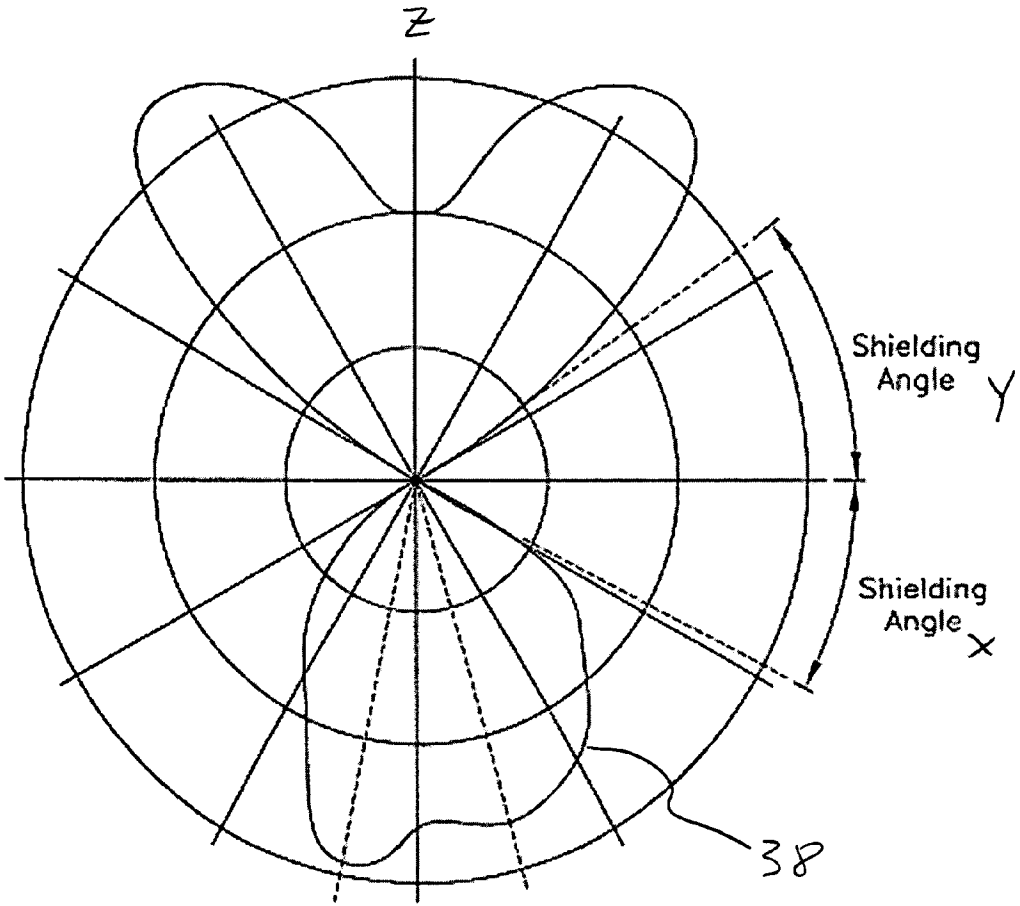
FIG. 5 (Prior Art)
FIG. 5 is a candlepower distribution curve representing luminous output in a transverse plane of the luminaire shown of FIG. 3.
Figure 6:
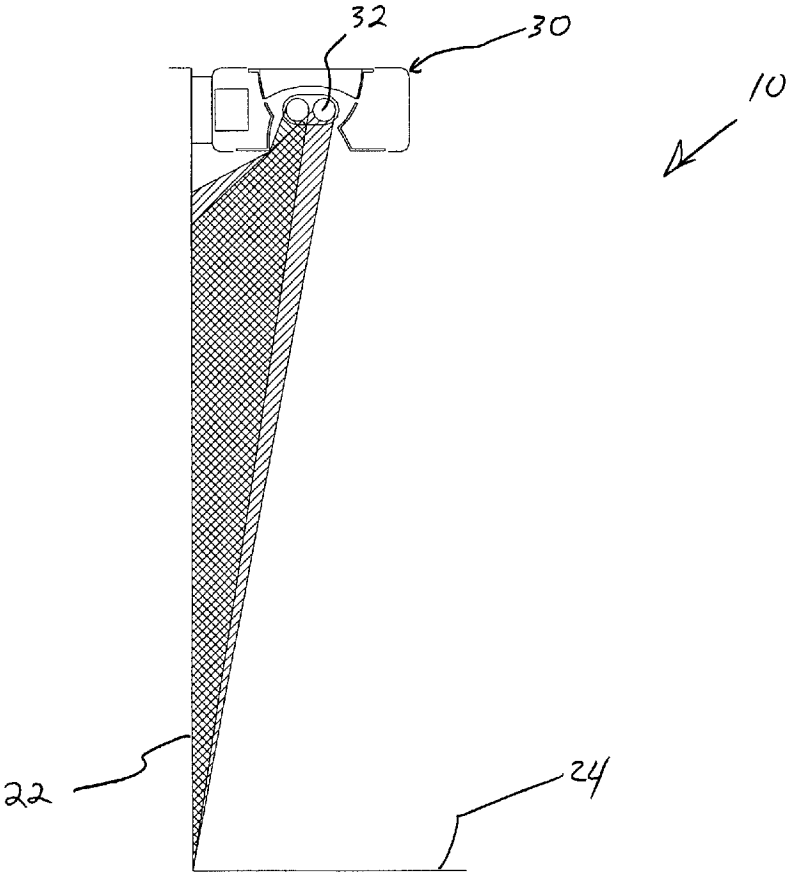
FIG. 6 (Prior Art)
FIG. 6 is a cross-sectional view showing the direct illumination of a workstation partition by the luminaire of FIG. 3.

However, FIG. 5 illustrates a candle power distribution of the luminaire 30 of FIG. 4. As shown, the downlight luminous output 38 of the luminaire 30 results in very little asymmetry in the case of the twin tube or multiple lamp 32 configuration where much more of the lamp 32 output is unaffected or reflected to a lesser degree as compared to the single-tube lamp 18 of the luminaire 12. FIG. 6 shows the direct illumination of the vertical surface 22 by the twin tube lamp 32 of the luminaire 30. A large portion of light emitted by the twin tube lamp 32 is directly incident on the vertical surface. This results in an undesirable over-exposure of the vertical surface thus degrading luminous uniformity within the workstation 10.

Figure 7:
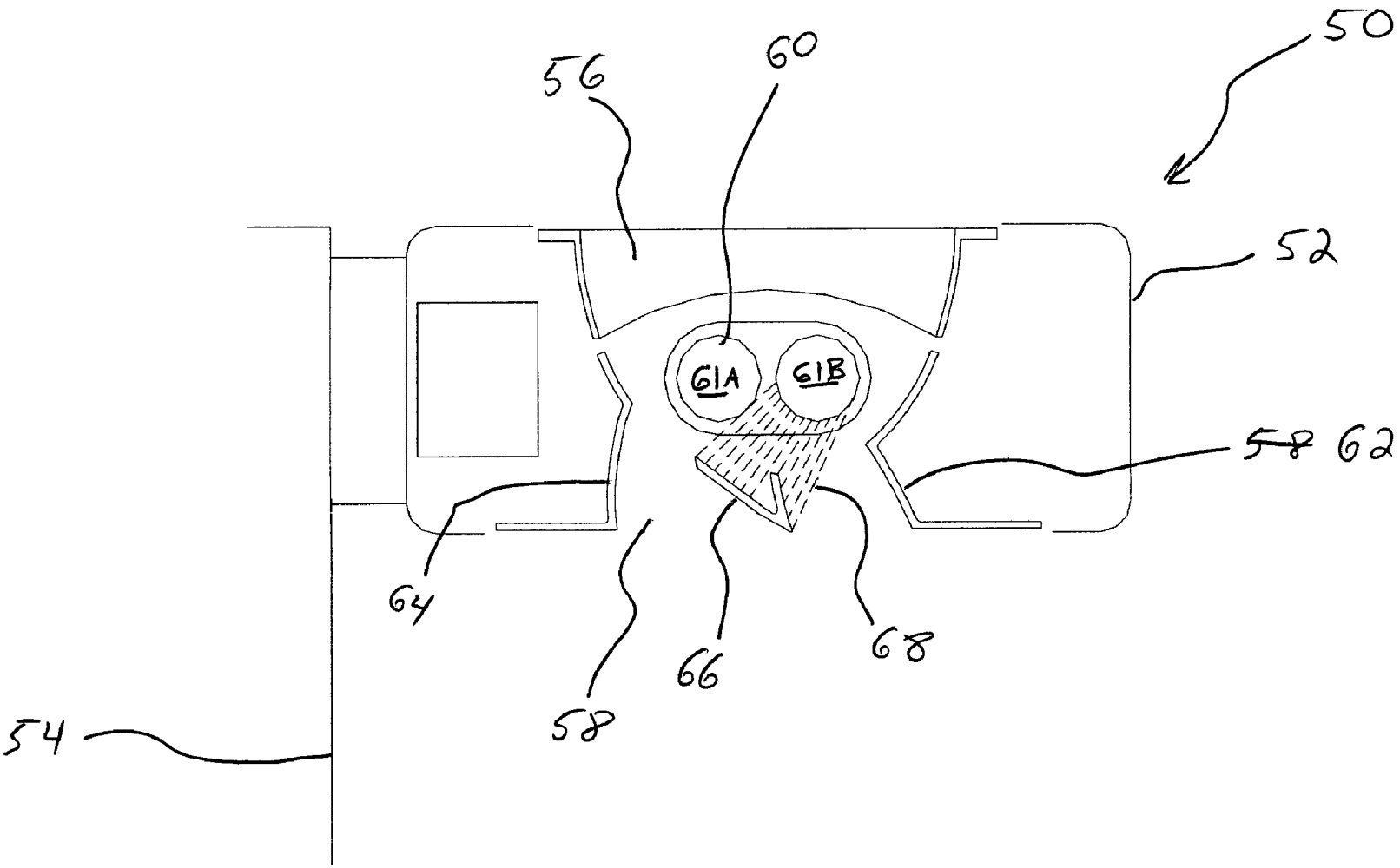
FIG. 7 is a cross-sectional view of a luminaire in an exemplary embodiment of the invention illustrating an interception of direct light rays by a reflector/shield.

To overcome these deficiencies of conventional luminaires, the invention provides a luminaire 50 as shown in FIG. 7 in one embodiment of the invention. The luminaire 50 includes a housing 52 which mountable on a vertical surface 54. Herein, the term vertical surface is used generally to mean any substantially upright surface on which it is desired to dispose the luminaire of the invention. The vertical surface 52 may comprise, for example, a wall, a privacy partition in a modular office arrangement, one or more stanchions or column-type supports, etc. The housing includes an upper aperture 56 and an oppositely disposed lower aperture 58. A long twin tube compact fluorescent lamp 60 is disposed at an interior of the housing 58 generally between the upper and lower apertures 56 and 58. The twin tube lamp 60 includes parallel adjacent lamp elements 61A and 61B which extend longitudinally through the housing 52 of the luminaire 50. The upper aperture 56 allows upwardly directed emanations from the lamp 60 to pass from the housing 52 to provide ceiling and/or ambient uplighting. The lower aperture 58 allows downwardly directed emanations from the lamp 60 to pass from the housing 52 to provide task-oriented downlighting. The housing 52 of the luminaire 50 further includes a first reflector 62 disposed in the lower aperture 58 proximate to the twin tube lamp 60 and generally disposed toward a front of the housing 52. The housing 52 of the luminaire 50 further includes a second reflector 64 disposed within the lower aperture 58 opposite from the first reflector 62, proximate to the twin tube lamp 60, and generally disposed toward a rear of the housing 52, i.e., closer to the vertical surface 54.

For convenience purposes, not all light rays emitted from the lamp 60 are shown in the Figures (e.g., light rays directed upward through upper aperture 56 are not shown) but it shall be understood that the lamp 60 emits light in all outward directions relative to the illustrated cross-section.

The luminaire 50 further includes a longitudinal shield element 66 disposed within the lower aperture 58 proximate to the twin tube lamp 60. The shield element 66 is configured to intercept and impede a portion of light rays emanating from each of the adjacent lamp elements 61A and 61B (see, e.g., FIGS. 7 and 8 and ensuing discussion). The shield element 66 may also include a reflective feature, as discussed further herein in detail, for redirecting light rays from the lamp 60 to a worksurface disposed below the luminaire 50 (see, e.g. FIG. 19) or upward through the upper aperture 56 for uplighting purposes. The shield may have a non-reflective (light absorbing) finish or may have a reflective (specular) finish on any or all of its surfaces to accomplish the redirecting of light rays described above. The shield element 66 is generally an elongated member which extends within the lower aperture 58 of the housing 52 proximate to the lamp 60 over an entire length of the lamp 60 or part of the length thereof. The shield element 66 may be rigidly secured within the housing 52 by any of a variety of means as discussed further herein in detail. The shield element 66 is composed of any sufficiently rigid and durable material and is partially or entirely opaque and/or may be coated with an opaque coating. For example, the shield element 66 may be composed of a plastic or a metal.

As illustrated in FIGS. 7-15, the shield element 66 is generally fashioned and positioned to intercept and impede the passage or certain light rays emanating from the lamp 60. The shield element 66 is fashioned and positioned to allow certain other light rays emanating from the lamp 60 to pass by the element 66 and to proceed onward toward the first and/or second reflectors 62, 64 and/or to the vertical surface 54 and or to the horizontal surface 55 of the workstation 80.

Figure 8:
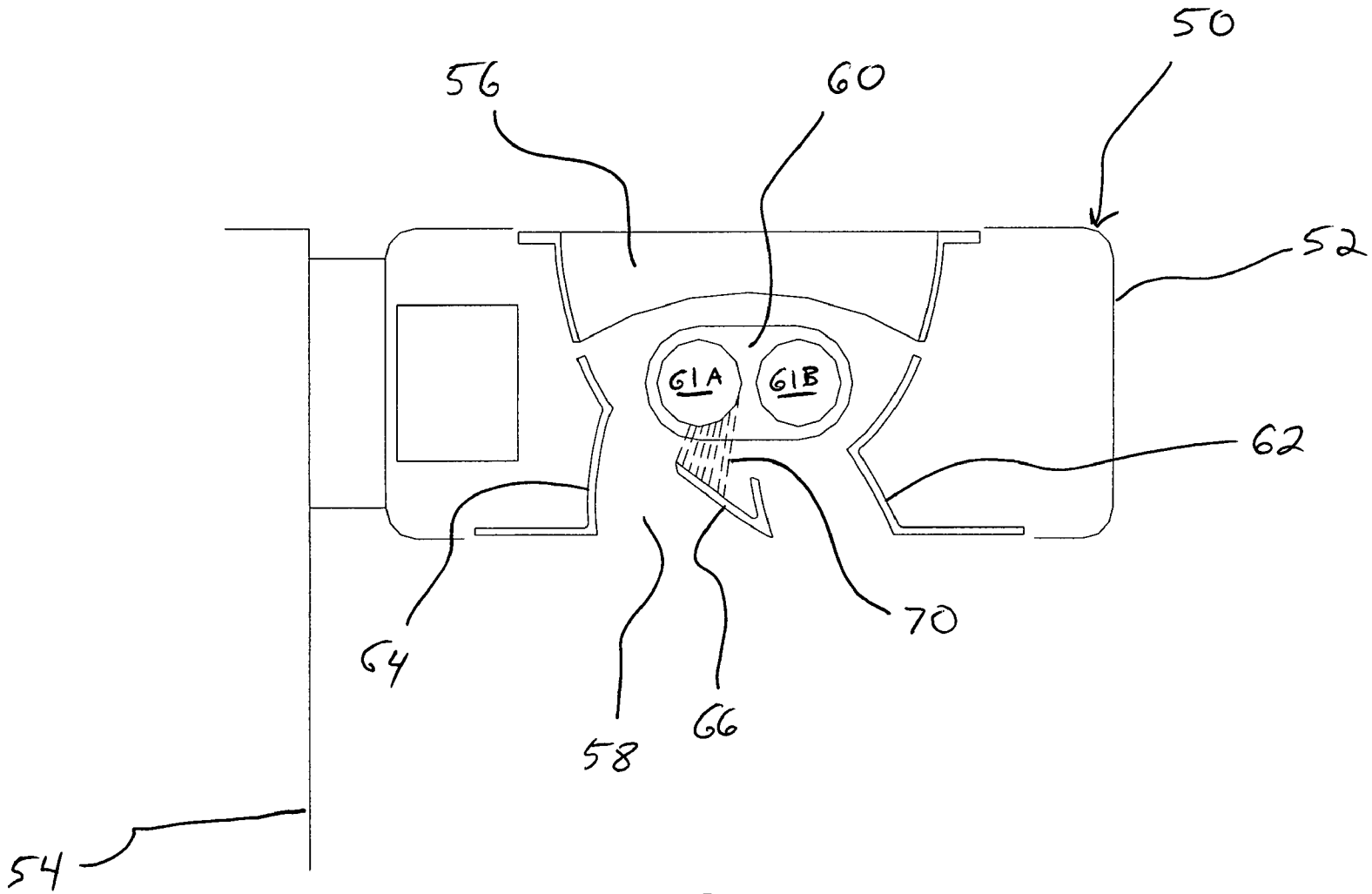
FIG. 8 is a cross-sectional view of the luminaire of FIG. 7 illustrating an interception of additional direct light rays by the reflector/shield.

As shown in FIG. 7, a portion 68 of the light ray output from lamp element 61B is intercepted by the shield 66 and is prevented from otherwise emanating directly to the vertical surface 54. Similarly, as shown in FIG. 8, a portion 70 of the light ray output of the lamp element 61A is intercepted by the shield element 66 and prevented from otherwise progressing directly to the vertical surface 54 and or the horizontal surface 55. That is, in FIGS. 7 and 8, light rays 68 and 70 are emitted from lamp elements 61B and 61A, respectively, and are incident upon the vertical surface 54 but for the interception of the light rays 68 and 70 by the shield element 66.

Figure 9:
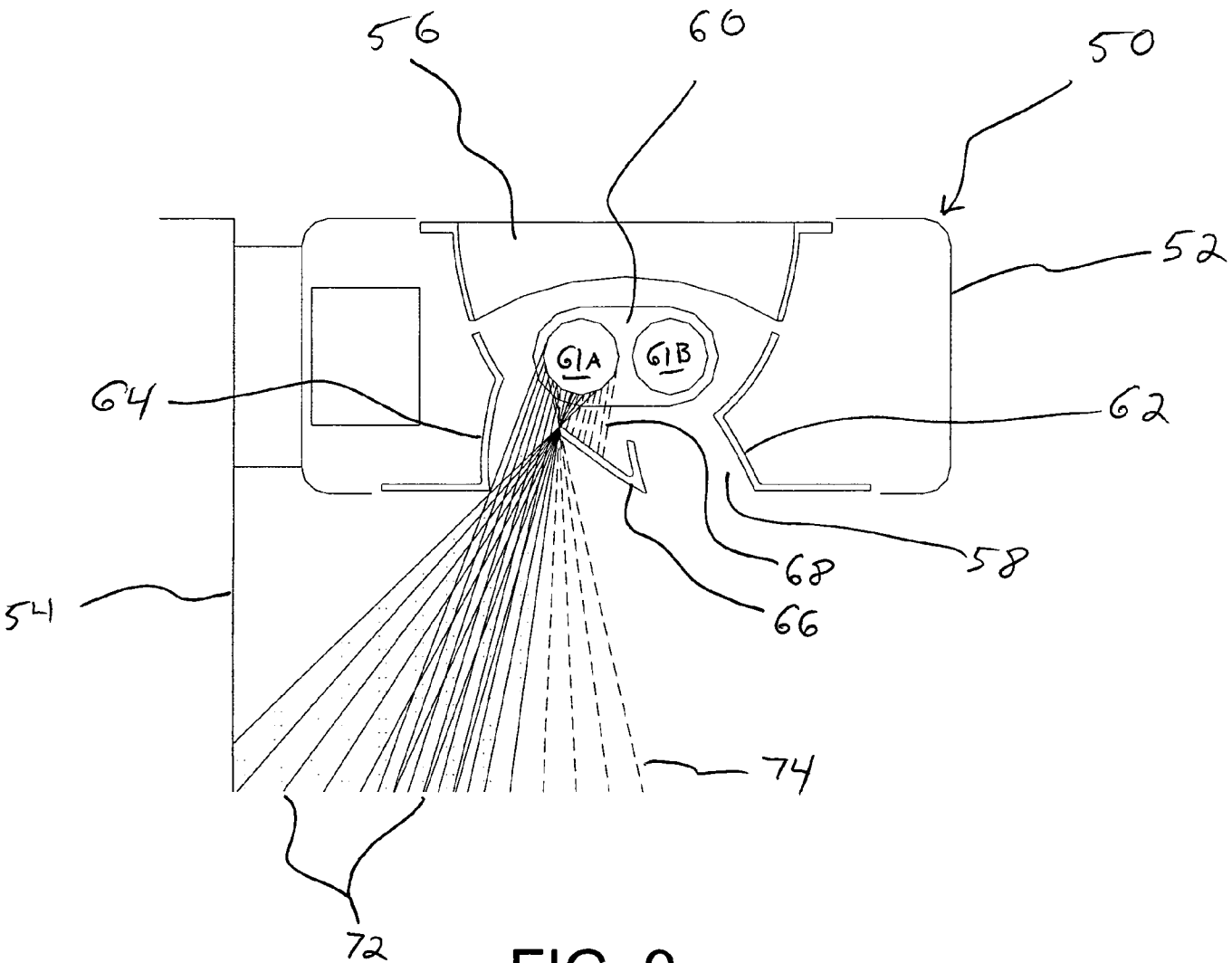
FIG. 9 is a cross-sectional view of the luminaire of FIG. 7 illustrating an emanation of direct light rays from one lamp element in a direction of an adjacent workstation partition.
Figure 10:
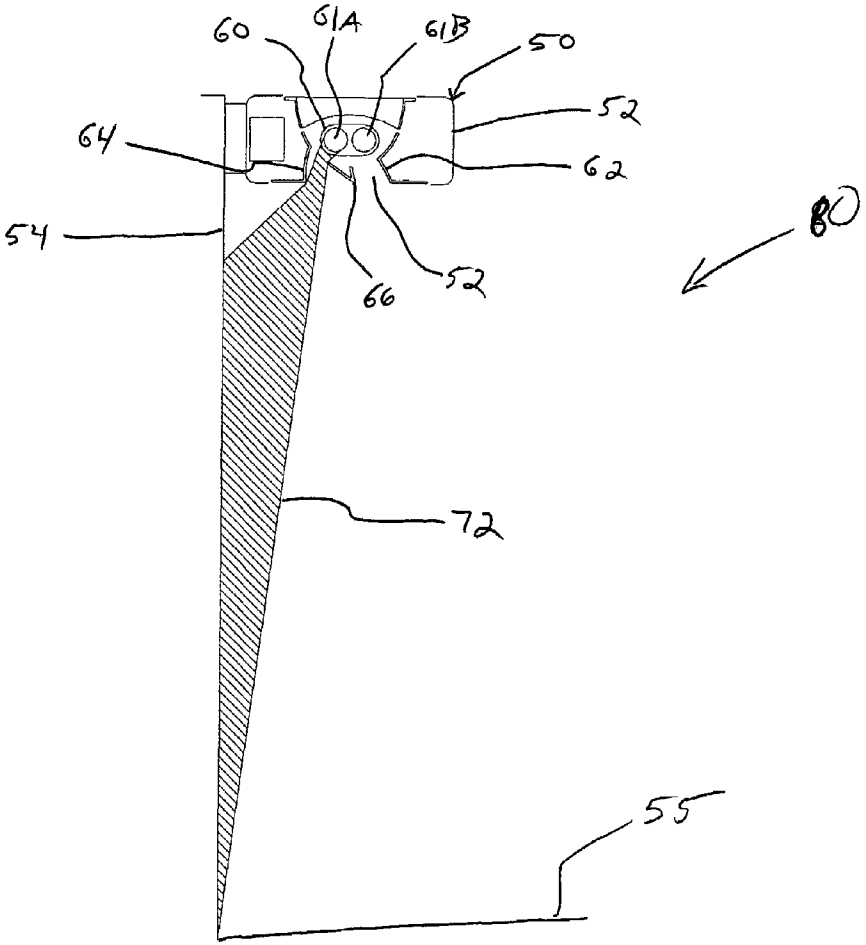
FIG. 10 is a cross-sectional view of the luminaire of FIG. 7 in a workstation illustrating direct illumination of a workstation partition by the light rays identified in FIG. 9.

FIG. 9 shows the light rays 68 from the lamp element 61A being intercepted by the shield element 66. FIG. 9 also shows additional light rays 72 which emanate from the lamp element 61 A which bypass the shield element 66 and are incident upon the vertical surface 54. Additional bypass light rays 74 circumvent the shield element 66 as shown and are incident upon the horizontal surface 55 of the workstation 80. FIG. 10 shows a view of the bypass light rays 72 incident upon the vertical surface 54.

Figure 11:
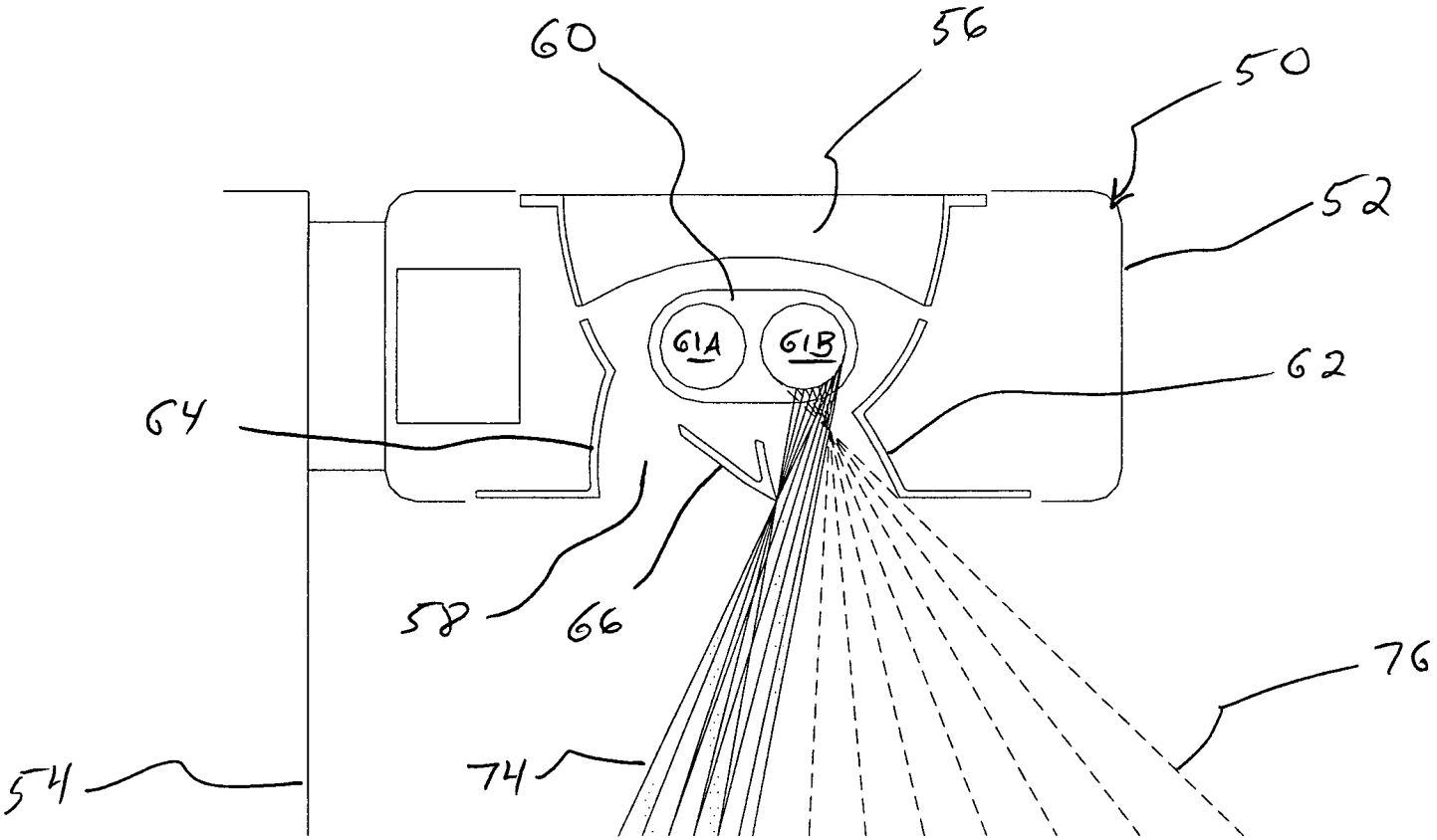
FIG. 11 is a cross-sectional view of the luminaire of FIG. 7, illustrating an emanation of direct light rays from a secondary lamp element in a direction of an adjacent workstation partition.
Figure 12:
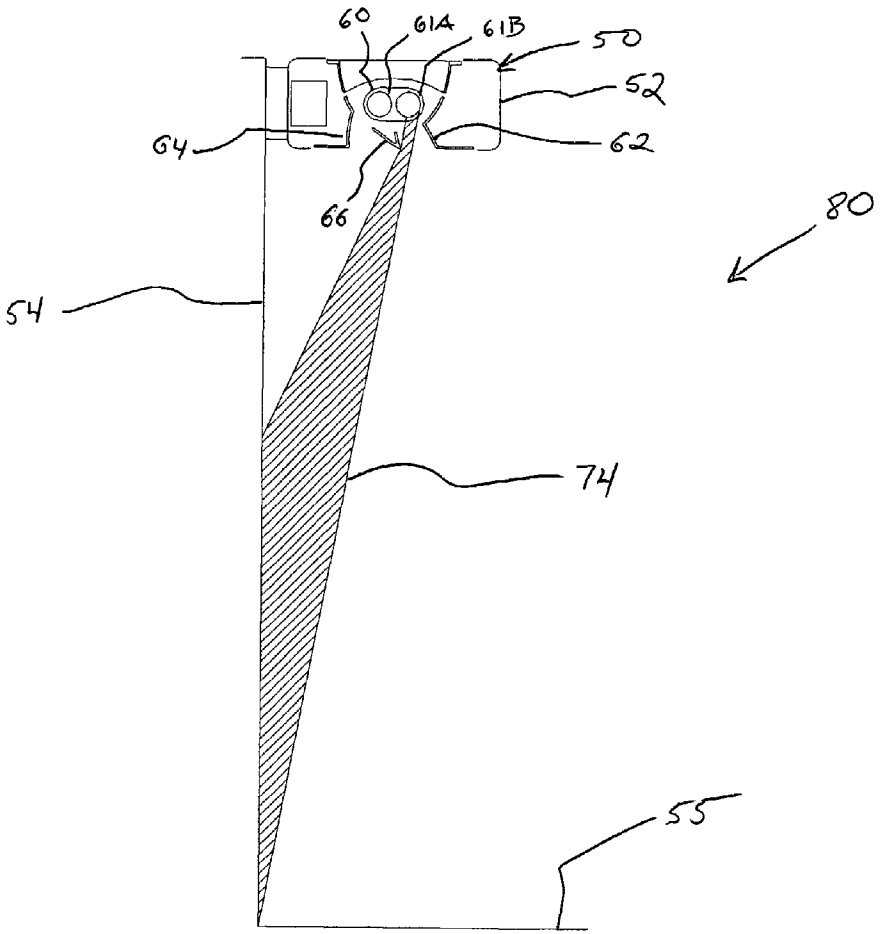
FIG. 12 is a cross-sectional view of the luminaire of FIG. 11 view showing the illumination of a workstation partition by the light rays identified in FIG. 11.

FIG. 11 shows light rays 74 which emanate from the lamp element 61B, which bypass the shield element 66, and which are incident upon the vertical surface 54. Additional bypass light rays 74 circumvent the shield element 66 as shown and are incident upon the horizontal surface 55 of the workstation 80. FIG. 12 shows a view of the bypass light rays 74 incident upon the vertical surface 54 of the workstation 80. That is, FIG. 12 shows the extent of direct light rays 74 from the lamp element 61 A which illuminate the vertical surface 54.

Figure 13:
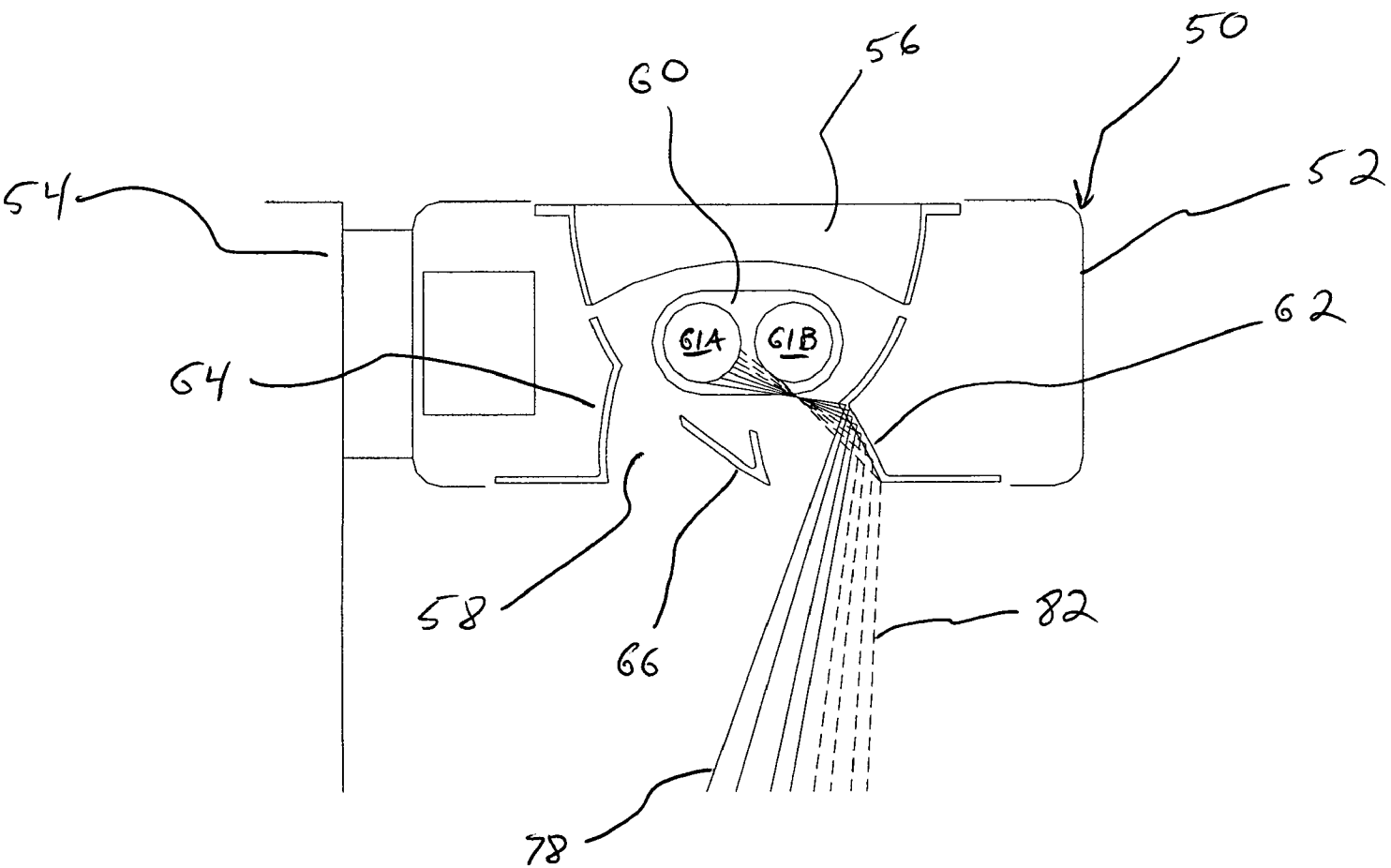
FIG. 13 is a cross-sectional view of the luminaire of FIG. 7 illustrating an emanation of reflected light rays in a direction of an adjacent workstation partition.
Figure 14:
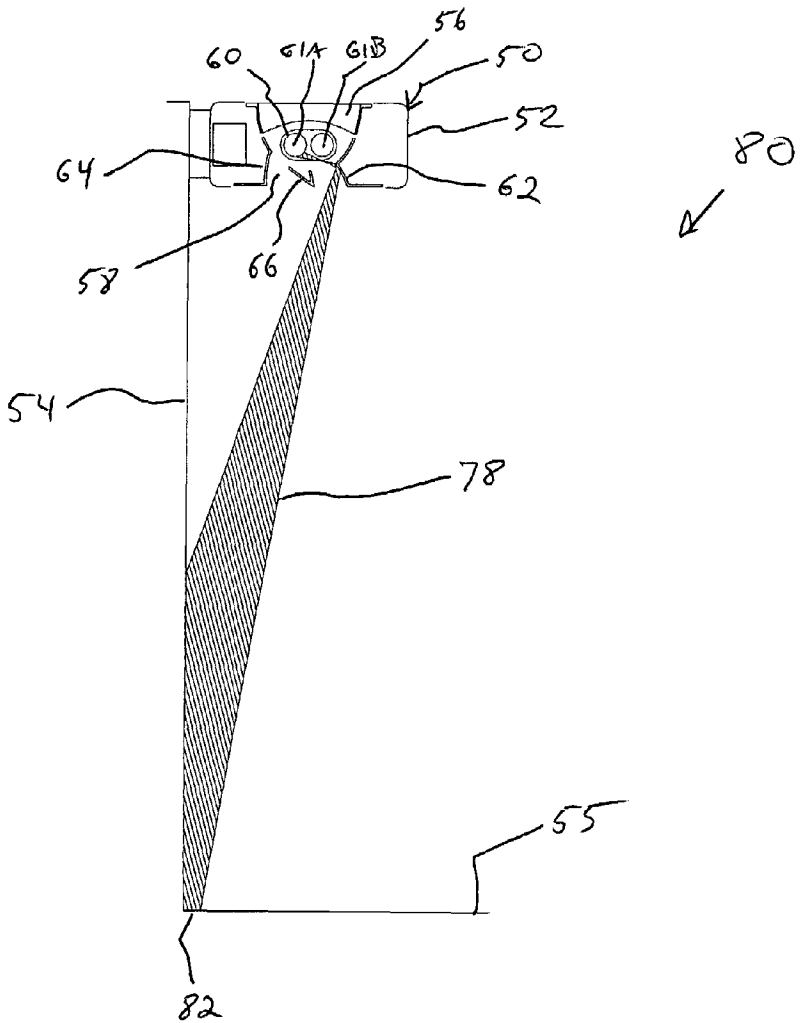
FIG. 14 is a cross-sectional view of the luminaire of FIG. 13 showing an illumination of the workstation partition by the light rays identified in FIG. 13.

FIG. 13 shows light rays 78 emanating from the lamp element 61A incident upon the first reflector 62. The reflector 62 redirects these light rays 78 essentially around the shield element 66 to the vertical surface 54, as particularly shown in FIG. 14. Additional light rays 82 emanate from the lamp element 61A to the first reflector 62 which then redirects the light rays 82 to a portion of the horizontal work surface 55.

Figure 15:
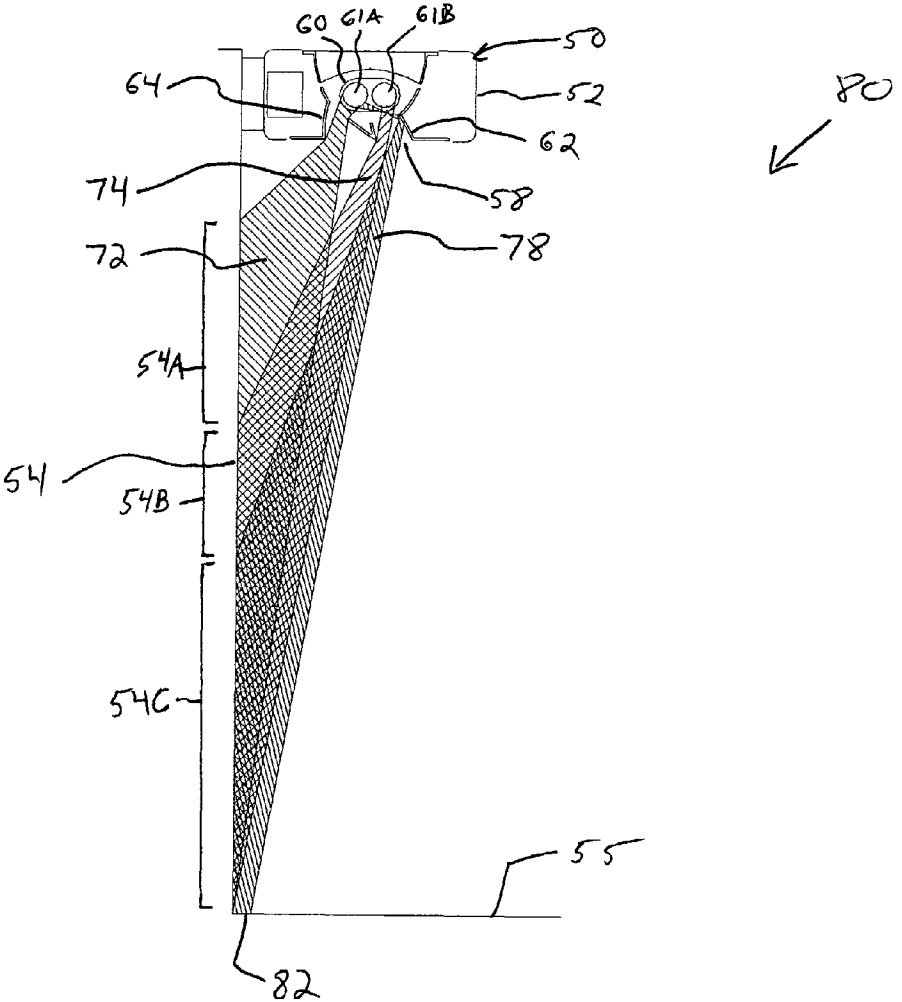
FIG. 15 is a cross-sectional view of the luminaire of FIG. 7 showing an illumination of a workstation partition by the direct and reflected light rays identified in FIGS. 9, 11 and 13.

FIG. 15 shows the cumulative effect of the shield element 66 upon the illumination of the vertical surface 54 by the twin tube lamp 60. As shown, the bypass light rays 72, which are emitted from the lamp element 61A around the shield element 66 and directly incident upon the vertical surface 54, serve to illuminate most entirely the vertical extent of vertical surface 54 including an upper portion 54A, a middle portion 54B, and a lower portion 54C of the vertical surface 54. Whereas, the redirected light rays 78 which also emanate from the lamp element 61A serve to illuminate more specifically the lower portion 54C of the vertical surface 54. The bypass light rays 74 emanating from the lamp element 61B around the shield element 66 and incident upon the vertical surface 54 generally serve to illuminate the lower vertical surface portion 54C and the middle vertical surface portion 54B. Notably, additional light rays 74 and 78 are added to the distribution as a distance along the vertical surface 54 from the luminaire 50 increases, thus compensating for loss of intensity associated with increased distance and decreasing angle of incidence to the vertical surface 54. Particularly, in the lower portion 54C of the vertical surface 54, all three groups of light rays 72, 74 and 78 are incident upon the surface 54. It is further noted that the shield element 66 only permits the light rays 72 to be directed incident upon the upper vertical surface portion 54A. This advantageous light distribution, provided in main part by the shield element 66, prevents against over-exposure of the upper vertical surface portion 54 while still allowing sufficient light rays to reach the lower vertical surface portion 54B most distal from the lamp 60.

Figure 16:
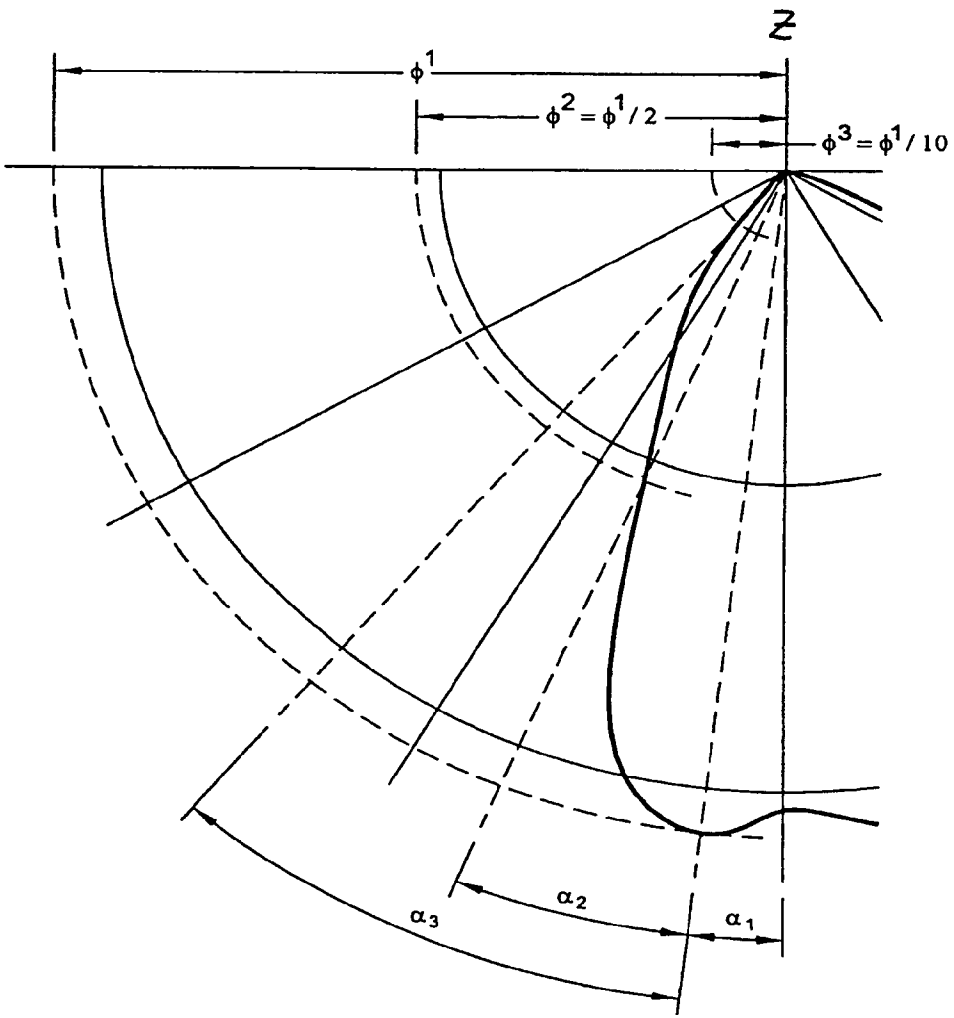
FIG. 16 is a partial candlepower distribution curve representing a luminous output in a transverse plane of the luminaire of FIG. 7 for a quadrant where adjacent workstation partitions are typically disposed.

The resultant intensity distribution of the luminaire 50 is illustrated in FIG. 16 and is characterized by a maximum intensity $\phi^1$ occurring at an angle $\alpha^1$, and further defined by a reduction of intensity at angles greater than $\alpha^1$ such that a point where the intensity is equal to $\phi^1/2$ (or $\phi^2$) occurs at angle $\alpha^2$ and such that a point where the intensity is equal to $\phi^1/10$ (or $\phi^3$) occurs at angle $\alpha^3$. Notably, for the exemplary luminaire embodiment shown, angle $\alpha^2$ occurs within approximately 16 degrees of angle $\alpha^1$ and angle $\alpha^3$ occurs within approximately 34 degrees of angle $\alpha^1$ where angle $\alpha^1$ is approximately 6.5 degrees. Clearly, this distribution results in a very desirable level of luminance uniformity across the extent of the vertical surface adjacent to the luminaire 50, this uniformity exceeding, in fact, that of the conventionally lamped luminaire 12 illustrated in FIGS. 1 and 2.

Figure 17:
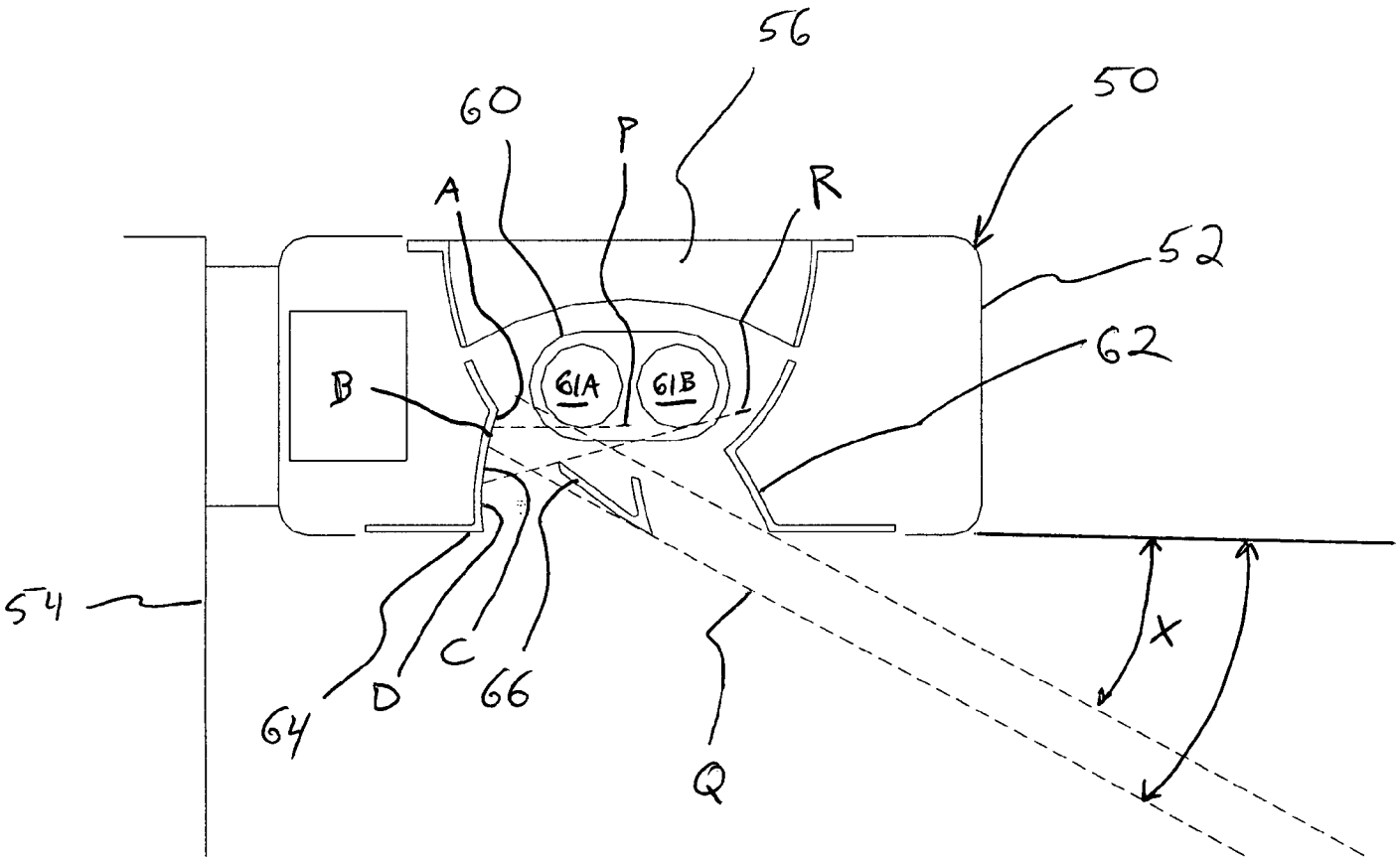
FIG. 17 is another cross-sectional view of the luminaire of FIG. 7.
Figure 18A:
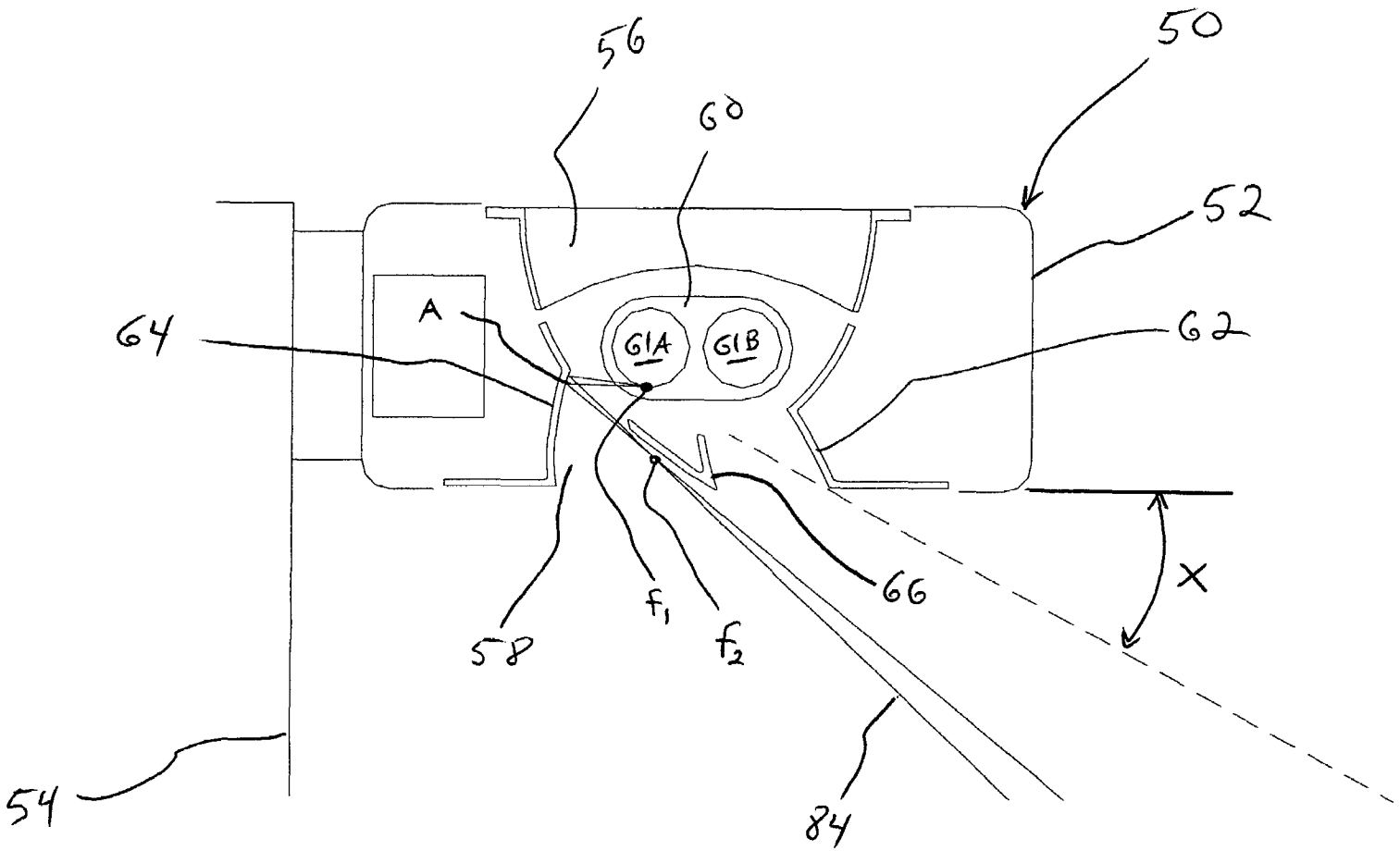
FIG. 18*a* is a cross-sectional view of the luminaire of FIG. 17 illustrating reflection of light rays from one downlight reflector segment.
Figure 18B:
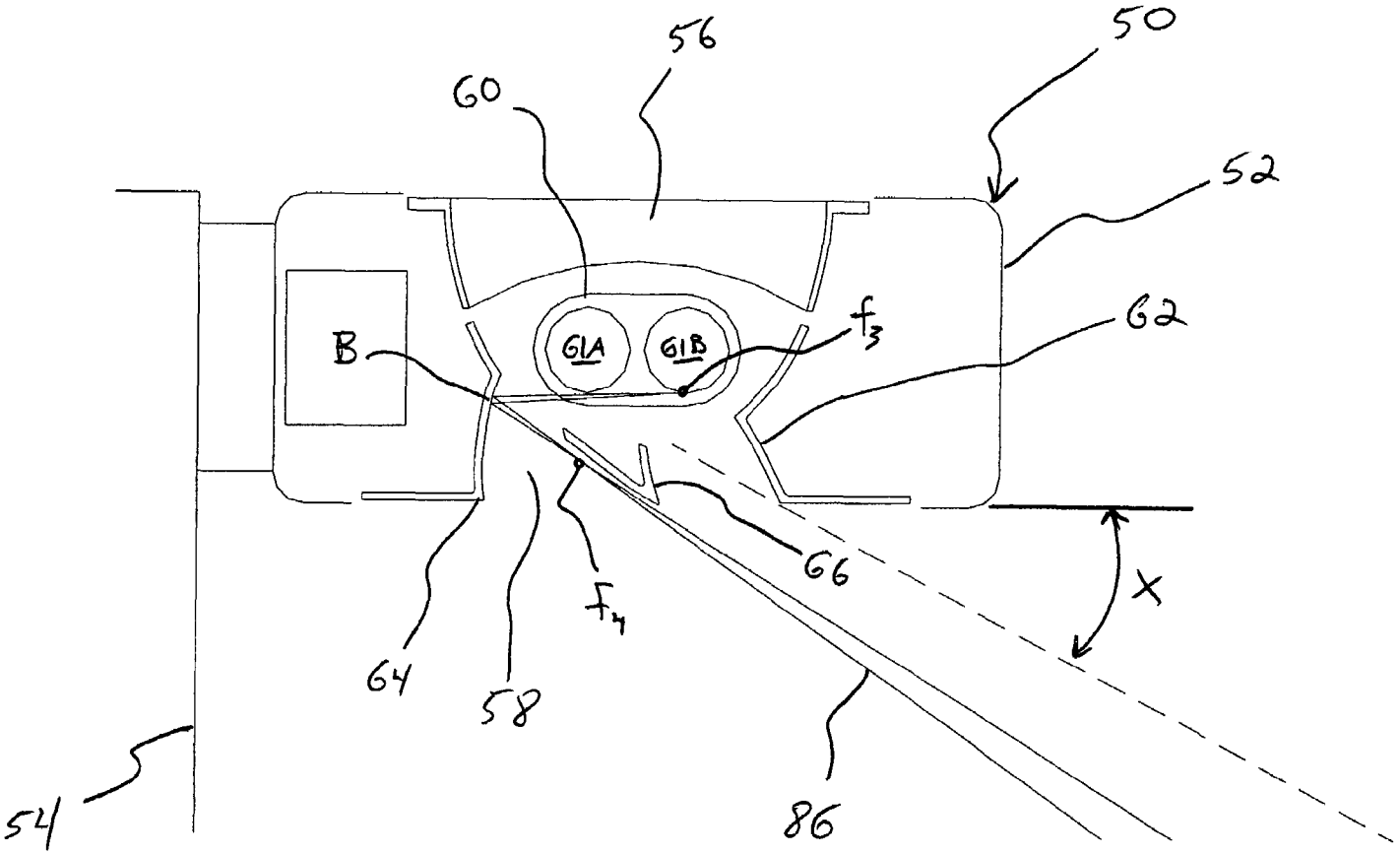
FIG. 18*b* is a cross-sectional view of the luminaire of FIG. 17 illustrating reflection of light rays from another downlight reflector segment.
Figure 18C:
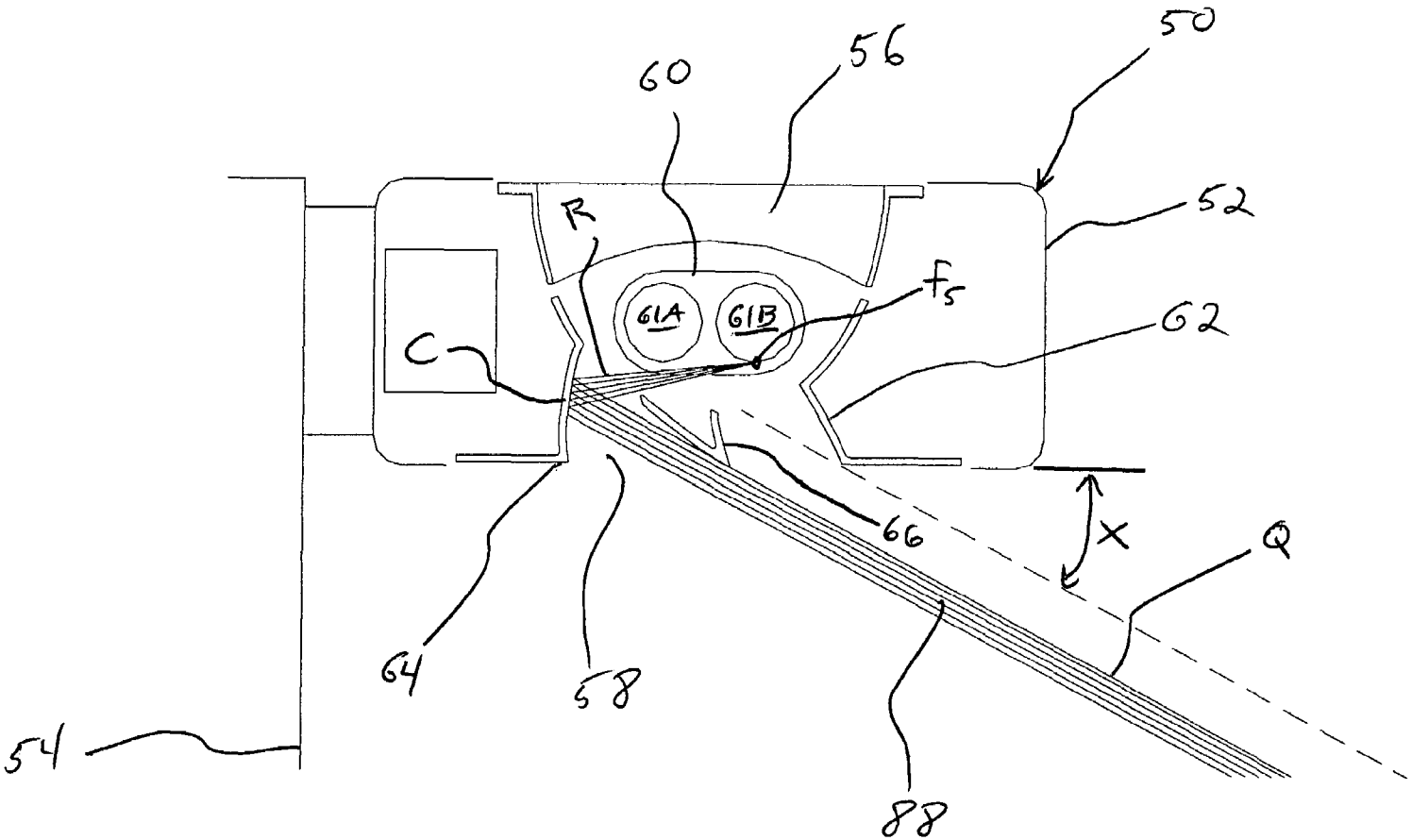
FIG. 18*c* is a cross-sectional view of the luminaire of FIG. 17 illustrating reflection of light rays from another downlight reflector segment.
Figure 18D:
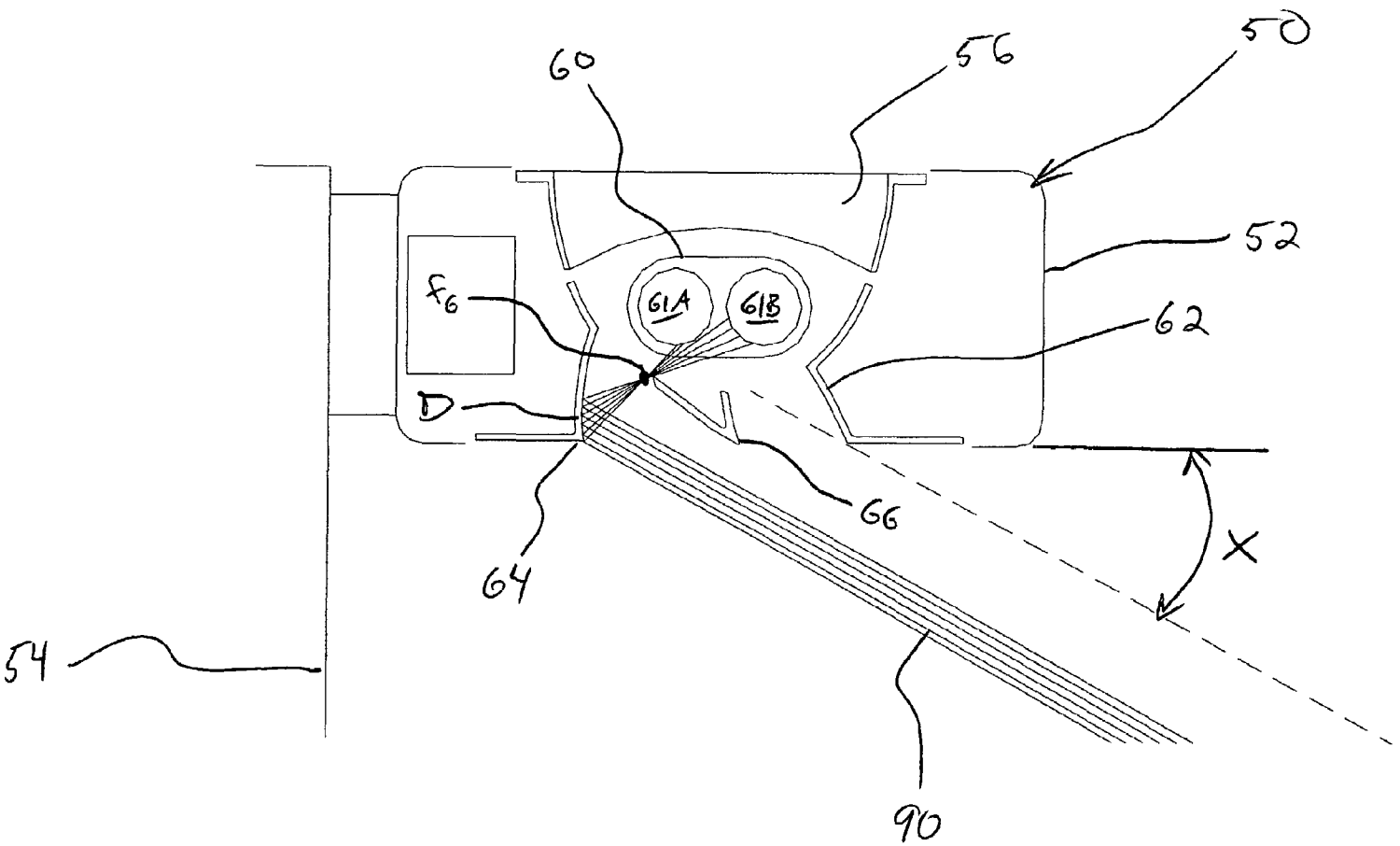
FIG. 18*d* is a cross-sectional view of the luminaire of FIG. 17 illustrating reflection of light rays from another downlight reflector segment.

The second reflector 64 is positioned within the housing 52 at the lower aperture 58. The reflector 64 extends longitudinally substantially along the aperture 58 adjacent to the twin tube lamp 60. The second reflector 64 is generally positioned and configured to direct light rays from within the housing 52 to useful task zones of the workstation 80. Particularly, the second reflector 64 is uniquely fashioned in accordance with the invention to comprise four continuous and blended segments as follows and as illustrated in FIG. 17. A segment A is bounded by a top edge of a curved surface of the reflector 64 and by a horizontal plane P tangent with a bottom profile of the lamp elements 61A and 6B. A segment B of the second reflector 64 is bounded by the same horizontal plane P and by a plane Q parallel to the downlight shielding angle and tangent with the bottom profile of the shield element 66. The reflector 64 further includes a segment C bounded by plane Q and an angled plane R extending through the reflector and tangent to a bottom profile of the lamp element 61B and tangent to a top profile of the shield element 66. Additionally, the reflector 64 includes a segment D bounded by plane R and a bottom edge of the curved surface of the reflector 64. Specifically, segments A, B, C, and D are fashioned as illustrated in FIGS. 18*a*-18*d* and as described below.

The reflector segment A is an elliptical section with focal points $f_1$ and $f_2$ whereby focal point $f_1$ occurs at a point that a plane extending from the top edge of the segment A is tangent to the bottom profile of lamp element 61A, and whereby the focal point $f_2$ is a point occurring below the shield element 66 through which light rays 84 from point $f_1$ on lamp element 61A may pass unobstructed and closest to but not above the shielding angle X.

The segment B of the reflector 64 is another elliptical section contiguous to reflector segment A having focal points $f_3$ and $f_4$, whereby focal point $f_3$ is coincident with an intersection of plane P and lamp element 61B, and whereby focal point $f_4$ is a point occurring below the shield element 66 through which light rays 84 from said point on lamp element 61A may pass unobstructed and closest to but not above the shielding angle X.

The segment C of the reflector 64 is a parabolic section contiguous to reflector segment B having a focal point $f_5$ coincident with an intersection of plane Q and lamp element 61B, and whereby reflected light rays 88 originating at the focal point $f_5$ are reflected at an angle parallel to the shielding angle along the plane Q.

Reflector segment D of the second reflector 64 is a parabolic section contiguous to reflector segment C having a focal point $f_6$ occurring at a point that plane R intersects a plane extending through lamp element 61A to the bottom edge of the segment D and tangent to the shield element 66, and whereby reflected light rays 90 originating at said focal point $f_6$ are reflected at an angle parallel to the shielding angle X.

Figure 19:
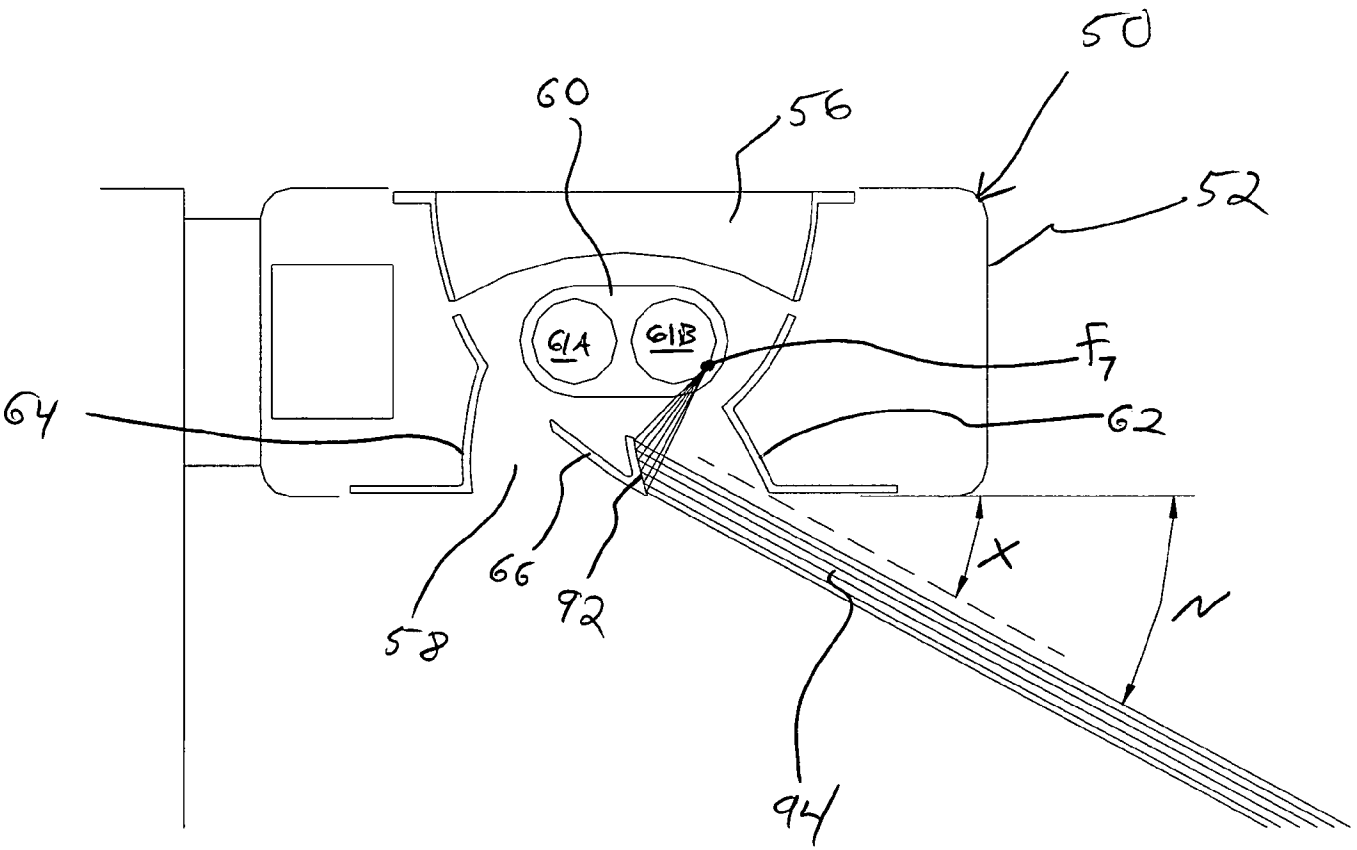
FIG. 19 is a cross-sectional view of the luminaire of FIG. 17 illustrating reflection of light rays by a shield element 66.

In an alternate embodiment of the invention, the shield element 66 may further be configured to redirect some of the light rays intercepted by the shield element 66 to useful task zones within the workstation 80. As shown in FIG. 19, the shield element 66 includes a parabolic reflector surface 92 disposed on a side of the shield element 66 generally proximate to the first reflector 62 of the luminaire housing 62. The parabolic reflector surface 92 is provided with a focal point $f_7$ which occurs where a line tangent to a leading edge of the shield element 66 (i.e., an edge furthest from the vertical surface 54) is tangent to a bottom profile of lamp element 61B and whereby reflected light rays 94 originating at said focal point $f_7$ are reflected at an angle N parallel to the shielding angle X.

Figure 20:
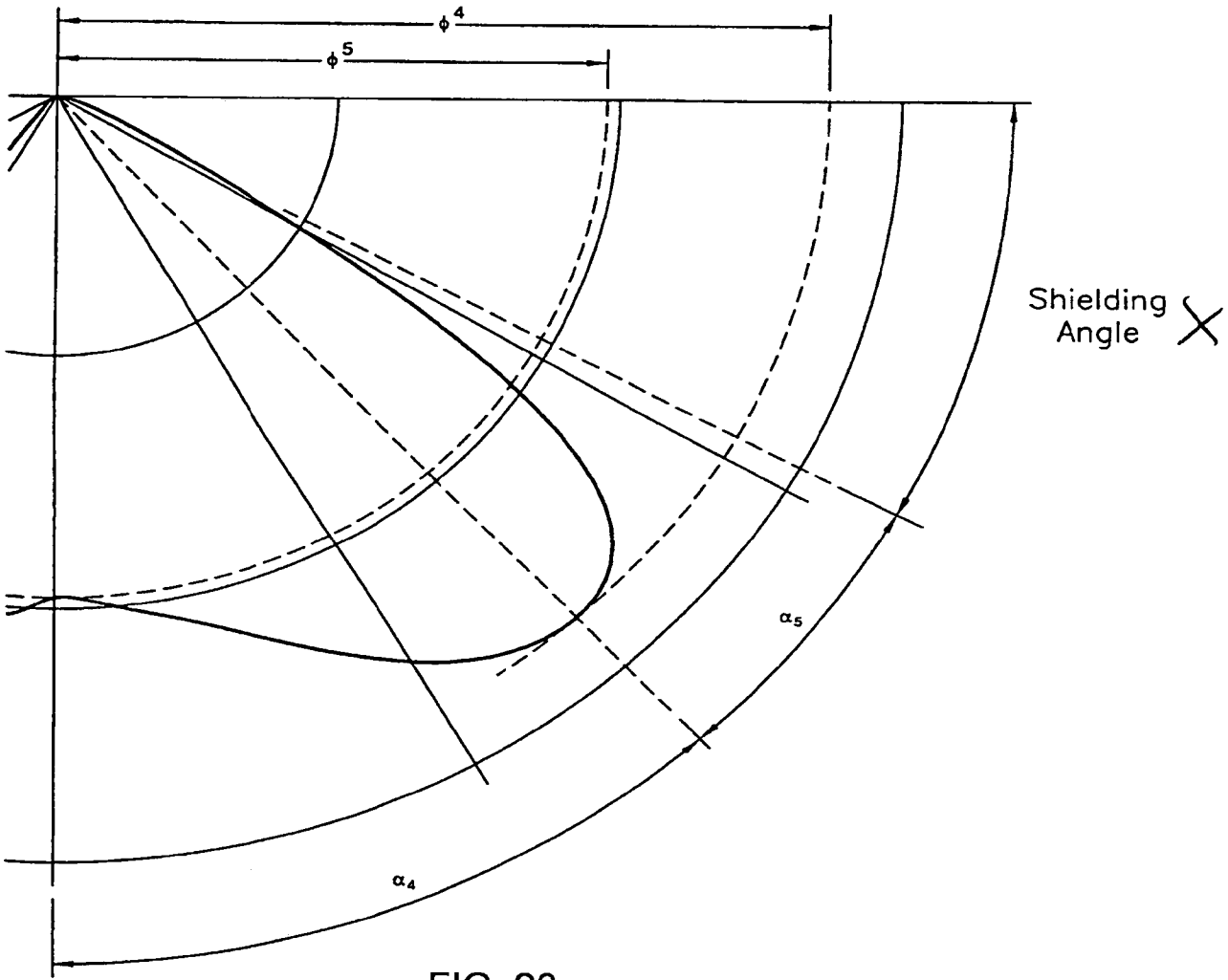
FIG. 20 is a partial candlepower distribution curve representing luminous output in a transverse plane of the luminaire shown of FIG. 17 for a quadrant where horizontal workstation work surfaces are typically disposed.

The resultant intensity distribution in the task lighting zone is illustrated in FIG. 20 and is characterized by a maximum intensity $\phi^4$ occurring at an angle $\alpha^4$ that is close to the shielding angle X and whereby the corresponding intensity at nadir ($\phi^5$) is less than approximately 72% of the maximum. Specifically, the angle between the shielding angle and the direction of maximum intensity is represented by $\alpha^5$ and is less than approximately 20 degrees.

Figure 21:
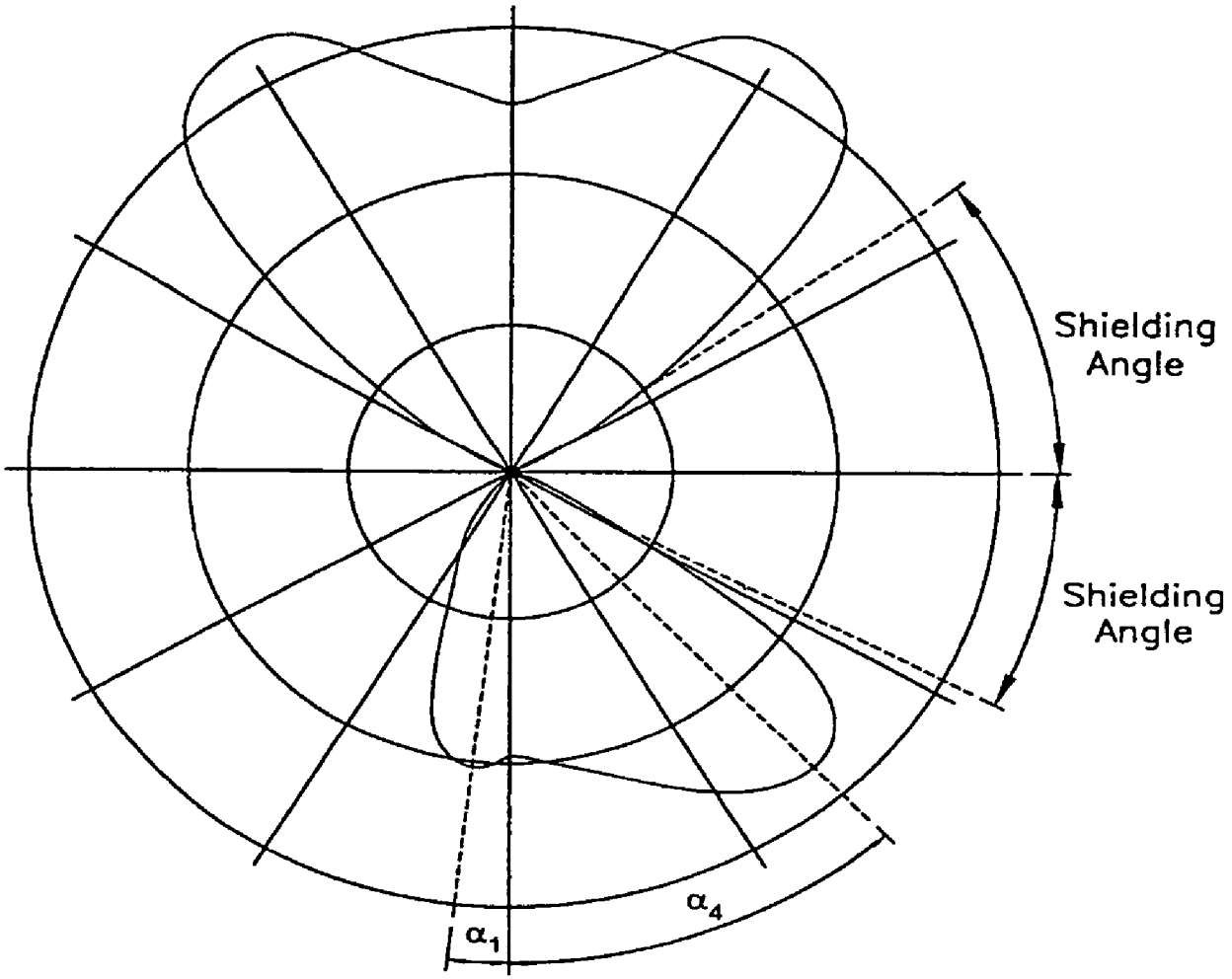
FIG. 21 is a partial candlepower distribution curve representing a complete downlight output in a transverse plane of the luminaire shown in FIGS. 7 and 17.
Figure 22:
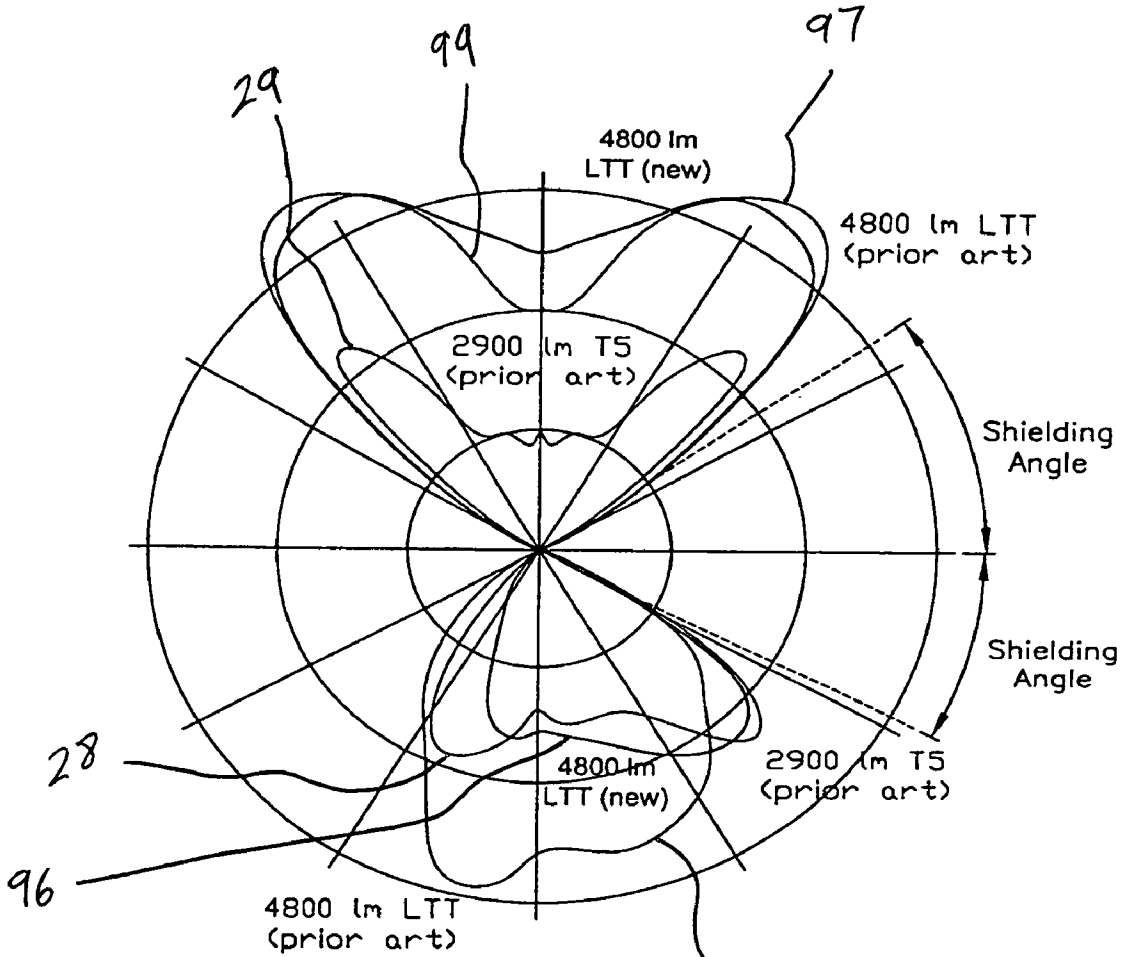
FIG. 22 is a composite representation of transverse plane candlepower curves for the luminaires shown of FIGS. 1, 3 and 7.

FIG. 21 illustrates the complete downlight intensity distribution for the embodiment of the invention described above. A comparison of the distributions shown in FIGS. 2, 5, and 21 is shown in FIG. 22. Notably, the invention provides improved control of long twin tube lamp output for lighting the vertical surface and horizontal work surface of a typical open office workstation and provides downlighting intensities and distribution comparable to longer luminaires utilizing standard output linear T5 lamp(s) while providing greater uplighting output from a more compact luminaire. As shown in FIG. 22, a downlight candlepower curve 96 delineates an asymmetric distribution which resembles the downlight output 28 of the luminaire 12 and which is more advantageously arranged, and is of a more suitable intensity for, lighting workstation surfaces than another prior art downlight intensity distribution 98. The uplight output 97 of the luminaire 50 is predictably similar to that of a prior art uplight distribution based on a similar lamping 97, and of a significantly higher intensity than the prior art uplight distribution 29 of the luminaire 12.

While it is highly desirable that task and task/ambient luminaires generate asymmetric transverse plane downlight distributions as described above, it is also common that such luminaires incorporate a clear linear prismatic "batwing" lens to divide and refract the transverse light rays such that they strike the work surface and associated horizontal visual tasks at an angle relative to the transverse viewing plane, thus reducing the occurrence of indirect glare and correspondingly increasing task contrast and visibility. Often such lenses extend an entire length of the relevant task light aperture. However, in elongated luminaires, a single section of lens, 18" or 24" in length for example, is sufficient assuming it is positioned at a primary task location.

Figure 23:
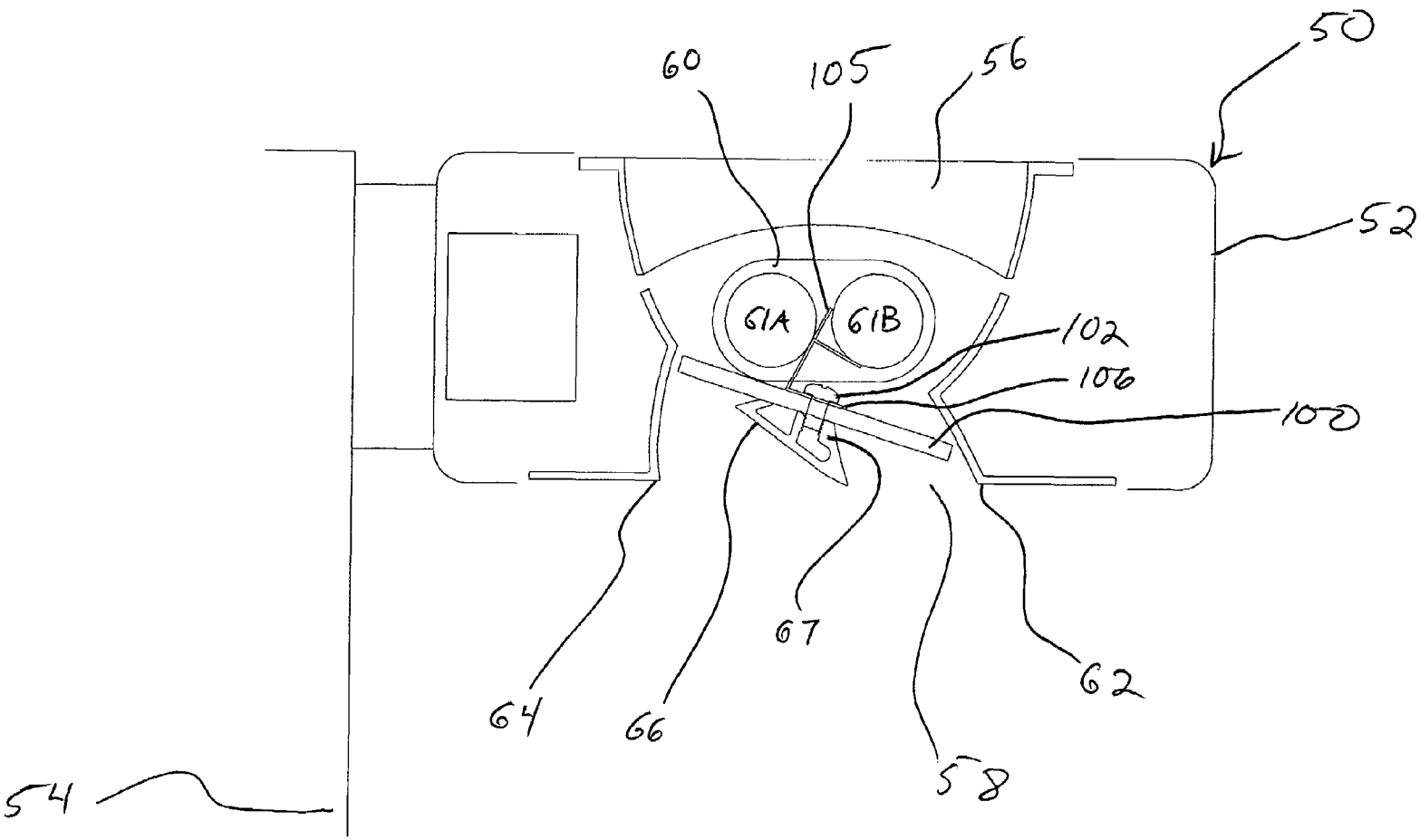
FIG. 23 is a cross-sectional view of an exemplary embodiment of a luminaire of the invention incorporating a prismatic batwing task lens.
Figure 24:
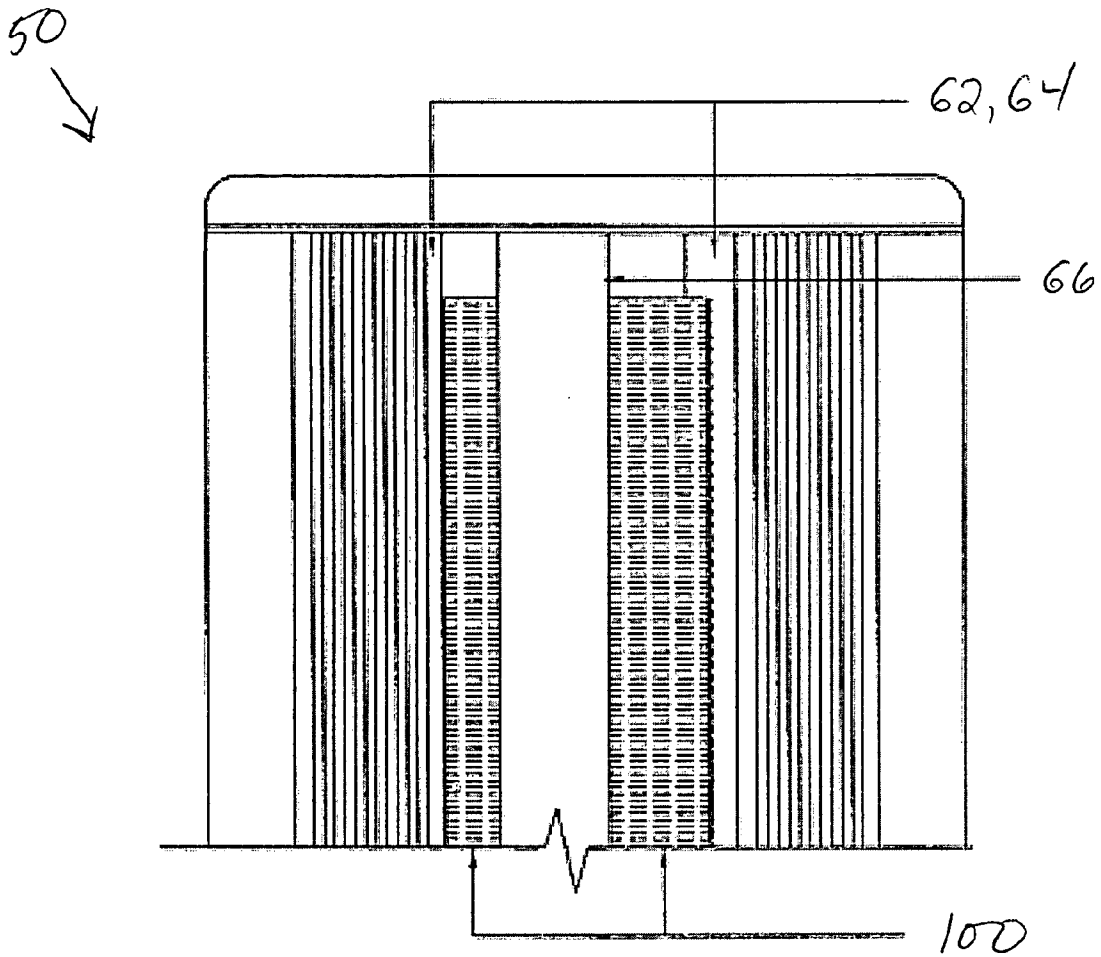
FIG. 24 is a partial bottom view of the luminaire of FIG. 24*a*.

While many methods for supporting such a lens are conceivable, the previously disclosed shield element 66 of the luminaire 50 provides a unique method for fixing a lens 100 in the downlight aperture 58 of the task or task/ambient luminaire 50, as illustrated in FIG. 23. Where the luminaire 50 is a compact luminaire having a length of approximately 24", it is conceived that the lens 100 would extend nearly an entire length of the luminaire 50. In the example of FIG. 23, the lens 100 is disposed between the shield element 66 and the twin tube lamp 60. More particularly, the lens 100 is supported by the shield element 66 and is fastened thereto by means of one or more screw(s) or bolt(s) 102. In this embodiment, the shield element 66 includes a threaded or ribbed portion 67 for receiving and retaining the screw 102. The shield element 66, while supporting and retaining the lens 100, is positioned and configured to intercept and redirect light rays emanating from the lamp 60, as described in detail hereinabove. The fixation of the lens 100 to the shield element 66 eliminates the need to mount the lens elsewhere within the housing 52. This means that the first and second reflectors 62 and 64 need not be marred or otherwise interrupted in order to receive and retain the lens. Additionally, no provisions are required of the housing 52 in order to support and retain the lens. Thus, construction of the luminaire housing 52 is simplified and the integrity of the reflectors 62, 64 and the housing 52 is preserved.

Figure 25:
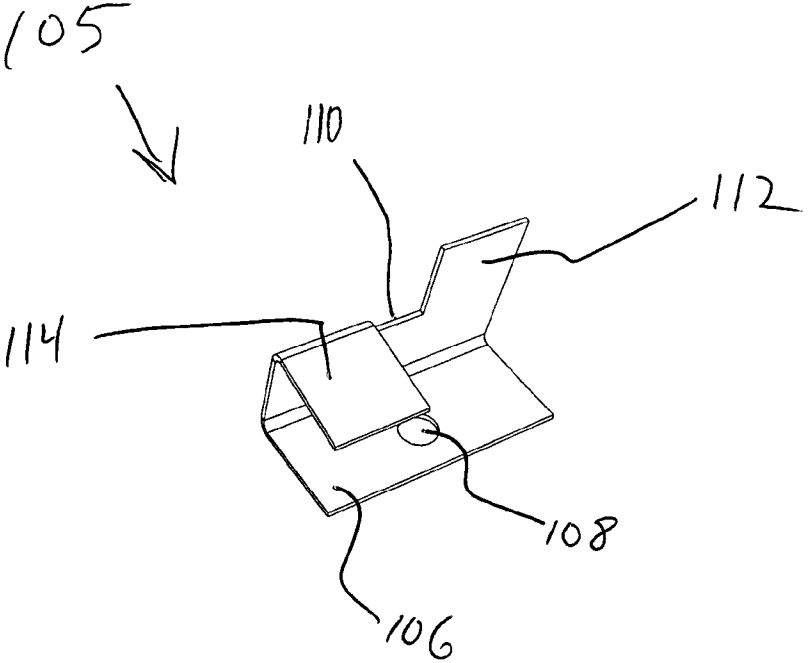
FIG. 25 is a perspective view of a lamp support/aligner.

Generally, the single-ended design of traditional long twin tube fluorescent lamps (i.e., contact pins disposed at one end of the lamp) requires that luminaires for said lamps be designed to provide support for the lamp in its operating position at a point distant from the lampholder. That is, the luminaire must be specifically designed to support the free end of the twin tube lamp (i.e., the end without the contact pins). Lamp manufacturers commonly specify recommended locations for the necessary structural supports. Further, it is also desirable to support the lamp in a manner that maintains its position relative to the luminaire reflector(s) and/or lens (es) in order to optimize illumination efficiency provided thereby. Notably, the previously described shield element 66 offers a unique means for providing this support and alignment when long twin tube lamps are employed in the exemplary luminaire 50 of the invention. FIG. 25 illustrates a lamp support/aligner 105 which is fixable to the shield element 66 for supporting the lamp 50 in a desirable position. FIG. 23 shows the lamp support/aligner 105 disposed in the housing 52 in operable association with the shield element 66 and the lens 100. The lamp support/aligner 105 includes a mounting base 106 having a mounting hole 108 formed therethrough for allowing passage of the screw 102. The lamp support/aligner 105 further includes an upright support member 110 which extends generally perpendicularly from the mounting base 106. The upright support member 110 includes a first tube element support 112 and a second tube element support 114 which is positioned at about 90 degrees relative to the first tube support 112, as shown in FIGS. 23 and 25. When the lamp support aligner 105 is disposed within the housing 52 of the luminaire 50, the second tube element 61B seats upon and is supported by the second tube element support 114. The first tube element 61A seats upon and is supported by a lower portion of the upright support member 110 and by the first tube element support 112, as illustrated in FIG. 23. The alignment of the first and second tube elements 61A and 61B is maintained by upright support member 110 being disposed between and bearing upon each of the first and second tube elements 61A and 61B. That is, the space between the parallel tube elements 61A and 61B is maintained by the lamp support/aligner 105. Moreover, the lamp elements 61A and 61B are supported in the vertical direction by the lamp support/aligner 105.

Of course, the precise configuration of the lamp support/aligner 105 can vary considerably under the broad scope of the invention. For example, the lamp/support aligner 105 maybe shaped or sized differently, it may be affixed to the shield element 66 in any of a variety of manners, it may be formed of a variety of materials, etc. Generally stated, the lamp support/aligner is an element which is fixable upon the shield element and which is configured to provide support in the vertical direction for the lamp of the luminaire and further configured to assist in maintaining a desired alignment of the lamp within the luminaire.

Persons skilled in the art will recognize obvious variations of the embodiments described above to include: other types of direct and direct/indirect luminaires associated with or not associated with office workstations; luminaires with other various types of top aperture shielding elements, including but not limited to, lenses, baffles and louvers; luminaires mounted in other positions and/or orientations; luminaires offering shielding angles other than those illustrated herein; luminaires in which the reflector and shielding elements described are fabricated of a variety of materials, including but not limited to, bright anodized extruded aluminum, formed aluminum reflector sheet, and metalized extruded or molded plastic. Also, it should be noted that the invention applies equally well where lamp elements 61A and 61B are two separate linear (or double-ended) lamps, i.e. elongated fluorescent lamps each independently supported and engaged by lampholders at both ends and where the lamp elements 61A and 61B are two adjacent portions of one twin tube lamp.

It can now be seen that there is provided a task/ambient workstation luminaire with highly desirable task lighting characteristics that provides greater ambient light output from a more compact luminaire than heretofore known.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A compact fluorescent luminaire mountable on a vertical surface of a workstation, the luminaire comprising:

a housing;

an aperture formed at an underside of the housing;

a lamp disposed within the aperture and oriented to emit light through the aperture to the vertical surface, wherein the lamp comprises first and second tube elements arranged adjacent to one another, the first tube element being proximate to the vertical surface, the second tube element being distal from the vertical surface;

a shield element disposed within the aperture adjacent to the lamp and extending longitudinally therewith;

wherein the shield element is configured to intercept first light rays emitted by the first tube element and intercept second light rays emitted by the second tube element and allow passage of third light rays emitted from the first and second tube elements where the third light rays illuminate at least a part of the vertical surface.

2. The luminaire of claim 1, wherein the first light rays are emitted by the first tube element in a direction toward an upper portion of the vertical surface and wherein the second light rays are emitted by the second tube element in a direction toward an upper portion of the vertical surface.

3. The luminaire of claim 2, wherein the third light rays are emitted from the first and second tube elements in a direction adjacent to the shield element such that the third light rays bypass the shield element and illuminate a lower portion of the vertical surface.

4. The luminaire of claim 2, wherein the third light rays are emitted from the first and second tube elements in a direction toward a reflector of the luminaire, wherein the reflector redirects the third light rays around the shield element such that the third light rays bypass the shield element and illuminate a lower portion of the vertical surface.

5. The luminaire of claim 1, wherein the shield element comprises a reflective surface for receiving fourth light rays from at least one of the first and second lamp elements and redirecting the fourth light rays to a work surface associated with the vertical surface.

6. The luminaire of claim 1, wherein the lamp is further oriented to emit task light through the lower aperture to a worksurface associated with the vertical surface, the luminaire further comprising an upper aperture formed at an upper side of the housing, the lamp being further oriented to emit light through the upper aperture to illuminate a ceiling or to provide ambient light.

7. The luminaire of claim 1, further comprising a lens extending at least partially along a longitudinal length of the lamp, wherein the lens is disposed in association with the shield element, and wherein the shield element is configured to support the lens.

8. The luminaire of claim 7, wherein the lens is disposed within the aperture between the shield member and the lamp and wherein the lens is fixedly mounted upon and supported in a vertical direction by the shield element.

9. The luminaire of claim 1, further comprising a support and alignment member disposed in association with the shield element and configured to support the first and second lamp elements in a vertical direction and further configured to maintain an alignment of the first and second lamp elements relative to one another and/or relative to the housing.

10. The luminaire of claim 9, wherein the support and alignment member comprises a mounting base configured to fixedly mount upon the shield member and an upright support member having a first portion for receiving and supporting the first lamp element and a second portion for receiving and supporting the second lamp portion, wherein at least part of the first and second portions is disposed between the first and second lamp elements to maintain the alignment thereof.

11. The luminaire of claim 1, wherein the shield element is disposed adjacent and proximate to the lamp within the aperture such that the shield element is not directly visible to a viewer of the luminaire.

12. The luminaire of claim 1, further comprising a first reflector disposed proximate to a front of the housing and a second reflector disposed proximate to a rear of the housing and proximate to the vertical surface, wherein the second reflector comprises a plurality of contiguous parabolic and/or elliptical sections configured to redirect fourth light rays emitted by at least one of the first and second lamp elements around the shield element and out of the aperture toward a worksurface associated with the vertical surface at an angle equal to or greater than a shielding angle.

13. The luminaire of claim 12, wherein the shielding angle comprises a viewing angle within which the first and second lamp elements are not visible to a viewer.

14. A luminaire comprising a housing mounted on a vertical surface and having a lamp with parallel lamp tube portions disposed at an interior of the housing, a shield element including:

an elongated opaque body member configured to be disposed adjacent to and proximate to the lamp at the interior of the housing and further configured to extend substantially along a length of the lamp;

an intercepting surface disposed on the body member and oriented to intercept first light rays emitted by the parallel lamp tube portions in a direction toward an upper portion of the vertical surface;

wherein the body member includes a narrow profile to allow second light rays emitted by the parallel lamp portions in a direction toward a lower portion of the vertical surface to pass around the shield element between the shield element and the housing.

15. The shield element of claim 14, further comprising a lens extending at least partially along a longitudinal length of the body member, wherein the lens is disposed in mountable association with the body member, and wherein the body member is configured to retain and support the lens.

16. The shield element of claim 15, wherein the lens is removable fixed to the body member by a fastener and wherein the lens is configured to be disposed between the body member and the parallel lamp tube portions.

17. The shield element of claim 14, further comprising a support and alignment member disposed in association with the body member and configured to support the parallel lamp tube portions in a vertical direction and further configured to maintain an alignment of the parallel lamp tube portions relative to one another and/or relative to the luminaire.

18. The shield element of claim 17, wherein the support and alignment member comprises a mounting base configured to fixedly mount upon the shield member and an upright support member having a first portion for receiving and supporting one of the parallel lamp tube portions and a second portion for receiving and supporting another of the parallel lamp tube portions, wherein at least part of the first and second portions is disposed between the parallel lamp tube portions to maintain the alignment thereof

19. A method of illuminating a workstation with a luminaire mounted to a vertical surface of the workstation, the luminaire comprising a lamp having first tube element disposed in the luminaire adjacent and parallel to a second tube element, the method comprising:

disposing a shield element at an interior of the luminaire proximate to the parallel lamp tube portions;

intercepting first light rays at the shield element emitted by the first tube element in a direction toward an upper portion of the vertical surface;

intercepting second light rays emitted by the second tube element in a direction toward the upper portion of the vertical surface; and allowing passage of third light rays emitted from at least one of the first and second tube elements where the third light rays illuminate at least a part of the vertical surface.

20. The method of claim 19, further comprising:

redirecting fourth light rays, emitted from at least one of the first and second tube elements, around the shield element such that the fourth light rays illuminate at least a part of the vertical surface; and retaining and supporting at least one of a lens, the first tube element, and the second tube element with the shield element.

* * * * *